US006070624A

United States Patent [19]

Bilbrey et al.

[11] Patent Number: 6,070,624

[45] Date of Patent: Jun. 6, 2000

[54] SERVICE-LINE VALVE CONNECTOR AND SPOUT VALVE

[75] Inventors: Robert Bilbrey, Orinda; Christopher C. Rutter, Oakland, both of Calif.

[73] Assignee: Packaging Systems, L.L.C., Romeoville, Ill.

[21] Appl. No.: 08/947,614

[22] Filed: Oct. 9, 1997

[51] Int. Cl.[7] ..... B65B 1/04

[52] U.S. Cl. ..... 141/346; 141/387; 137/625.19; 222/548; 222/555

[58] Field of Search ..... 141/346, 387; 215/313; 137/625.19, 614.05; 222/548, 554, 555

[56] References Cited

U.S. PATENT DOCUMENTS

| | | | |
|---|---|---|---|
| 848,152 | 3/1907 | Booth | 222/548 |
| 3,129,860 | 4/1964 | Foster | 222/512 |
| 3,800,987 | 4/1974 | Kemp | 222/153 |
| 5,597,021 | 1/1997 | Crossdale et al. | 141/346 |

*Primary Examiner*—Henry J. Recla
*Assistant Examiner*—Timothy L. Maust
*Attorney, Agent, or Firm*—Majestic, Parsons, Siebert & Hsue

[57] ABSTRACT

A quick-disconnect fluid coupling is provided that includes a spout assembly comprising a spout fitment having a first fluid opening and a spout valve member having a second fluid opening and capable of rotating from a first position to a second position to form a spout fluid path between the first and second fluid openings. The fluid coupling also includes a service-line connector comprising a line fitment member including a third fluid opening, and a connector valve member having a fourth fluid opening and capable of rotating from a third position to a fourth position to form a connector fluid path between the third and fourth fluid openings, whereby a spout-connector fluid path is formed between the second and fourth fluid openings upon attachment of the service-line connector to the spout assembly. The connector valve member further includes an engagement mechanism for engaging with the spout valve member in a manner that rotation of the connector valve member for coupling in series the spout and connector fluid paths by way of the spout-connector fluid path to form a substantially straight fluid path.

26 Claims, 16 Drawing Sheets

SERVICE-LINE VALVE CONNECTOR AND SPOUT VALVE

BACKGROUND OF THE INVENTION

This invention relates generally to service-line valve connectors, spout fitments and their couplings, and in particular, to a service-line connector and spout fitment whose coupling provides for fluid flow therethrough to follow a substantially straight fluid path.

Service-line valve connectors and spout fitments are widely used in the food and beverage industry, for example to facilitate packaging, distributing, protecting and dispensing of food and beverage products. Typical desired characteristics of such connectors and fitments are, for example, that they are capable of easily being assembled and disassembled for cleaning such devices and for ease of packaging the food and beverage products; capable of being rugged and durable during shipping of the food and beverage products; capable of protecting food and beverage products against contamination, by for example protective sealings; and capable of allowing the desired fluid flow during operation of the connection.

Of particular interest to the invention is the dispensing of condiments, such as, for example, ketchup, mustard, mayonnaise, relishes, and pasta and pizza sauce products. These types of products present particular problems for the design of service-line connectors, spout fitments and their fluid connections. Not only are condiment products generally more viscous than beverage products, they often contain relatively large food particulates. Because of the viscous nature of condiment products, obtaining a desired fluid flow rate through service-line connectors and container spouts is of particular concern. Thus, there is a need for a service-line connector/spout fitment connection which allows considerable fluid flow therethrough to achieve a desired fluid flow rate, useful for dispensing thick condiment products.

As mentioned in the previous paragraph, another concern with condiment products is that they often contain large food particulates. Large food particulates can be a potential problem for service-line connectors and spout fitments since these particulates can get lodged near the fluid openings or valves, and thereby impede or prevent fluid flow through the connection. Hence, there is a need for not only providing considerable fluid flow through service-line connectors and their mating spouts, but there is also a need for such devices that prevents and/or resolves blockage of the fluid path through said connection due to food particulates.

As with any other service-line connectors and spouts generally, there is a need for such devices that protects against contamination during shipping and dispensing, that can be easily assembled and disassembled for facilitating the cleaning of these devices and the packaging of the fluid or condiment products; and that are rugged and durable so that they can withstand forces exerted on them during shipping and handling of the condiment products.

OBJECTS OF THE INVENTION

Hence, it is an object of this invention to provide a service-line connector, spout assembly and fluid connection thereof, that is useful for dispensing food and beverage products, including condiment products which can be viscous in nature and contain relatively large food particulates;

It is another object of this invention to provide a service-line connector, spout assembly and fluid connection thereof, that provides a substantially straight fluid path through the coupling or a substantial portion thereof to allow a desired fluid flow therethrough;

It is also another object of this invention to provide a service-line connector, spout assembly and fluid connection thereof, that allows for a secured attachment of the coupling and opening of the valves with a single rotational movement of an element of the service-line connector.

It is yet another object of this invention to provide a service-line connector, spout assembly and fluid connection thereof, that prevents and resolves blockage of the fluid path by food particulates being lodged in the area near the fluid openings and valves; and It is yet another object of this invention to provide a service-line connector, spout assembly and fluid connection thereof, that can be easily assembled and disassembled to facilitate packaging of the food and beverage products and cleaning of these devices.

SUMMARY OF THE INVENTION

These and additional objects are accomplished by the various aspects of the present invention, wherein, briefly and generally, a quick-disconnect fluid coupling is provided for selectively establishing a substantially straight fluid path through the coupling, comprising: a spout assembly for attachment to and fluid communication with a container comprising: a spout fitment including a cover having a first fluid opening therethrough for fluid communicating with the interior of the container, and a spout valve member having a second fluid opening and capable of rotating from a first position whereat there is an absence of a spout fluid path coupling the first and second fluid openings, to a second position whereat there is a presence of the spout fluid path coupling the first and second fluid openings.

The quick-disconnect fluid coupling further includes a service-line connector comprising: a line fitment member including a line fitting for attachment to and fluid communication with a fluid flow line, the fitting including a third fluid opening, and a connector valve member having a fourth fluid opening and capable of rotating from a third position whereat there is an absence of a connector fluid path coupling the third and fourth fluid openings, to a fourth position whereat there is a presence of the connector fluid path coupling the third and fourth fluid openings, the fourth fluid opening being situated with respect to the second fluid opening of the spout valve member that upon attachment of the service-line connector to the spout assembly, a spout-connector fluid path is formed coupling the second and fourth fluid openings.

The connector valve member further includes an engagement mechanism for engaging with the spout valve member in a manner that rotation of the connector valve member from the third position to the fourth position causes the spout valve member to rotate from the first position to the second position, whereat the spout fluid path, the spout-connector fluid path and the connector fluid path are coupled in series, thereby forming the substantially straight fluid path.

Also provided is a spout assembly for attachment to and fluid communication with a service-line connector comprising: a spout fitment including a cover having a first fluid opening therethrough; and a spout valve member having a second fluid opening therethrough and capable of rotating from a first position whereat there is an absence of a spout fluid path coupling the first and second fluid openings, to a second position whereat there is a presence of the spout fluid path coupling the first and second fluid openings, the spout valve member further having an engagement mechanism capable of engaging with a rotating member of the service-line connector in a manner that rotation of the rotating member causes the spout valve member to rotate from the first position to the second position.

In addition, a service-line connector is provided for attachment to and fluid communication with a spout assembly and a fluid flow line, comprising: a line fitment member including a line fitting for attachment to and fluid communication with the fluid flow line, the fitting including a first fluid opening; and a connector valve member having a second fluid opening and capable of rotating from a first, position whereat there is an absence of a connector fluid path coupling the first and second fluid openings, to a second position whereat there is a presence of the connector fluid path coupling the first and second fluid openings, the connector valve member further including an engagement mechanism for engaging with a rotating valve member of the spout assembly in a manner that upon rotation of the connector valve member from the first position to the second position causes the spout rotating valve member to rotate to an opened valve position for establishing a fluid connection between the spout assembly and the service line-connector through the second fluid opening.

Also provided herein is a valve structure for selectively establishing a substantially straight fluid path from a proximal end to a distal end of the valve structure, comprising: a first stationary member situated at the proximal end of the valve structure and having a first fluid opening therethrough; a first valve member situated closer to the distal end than the first stationary valve member, the first valve member having a second fluid opening therethrough and capable of movement with respect to the first stationary valve member from a first position whereat there is an absence of a first fluid path coupling the first and second fluid openings, to a second position whereat there is a presence of the first fluid path coupling the first and second fluid openings.

The valve structure further comprises a second stationary valve member situated at the distal end and having a third fluid opening therethrough; and a second valve member situated closer to the distal end than the first valve member, but farther from the distal end than the second stationary valve member, the second valve member having a fourth fluid opening therethrough and capable of movement from a third position whereat there is an absence of a second fluid path coupling the third and fourth fluid openings, to a fourth position whereat there is a presence of the second fluid path coupling the third and fourth fluid openings. The second valve member further including an engagement mechanism for engaging with the first valve member in a manner that movement of the second valve member from the third position to the fourth position causes the first valve member to move from the first position to the second position, whereat the first and second fluid paths are coupled to form the substantially straight fluid path.

A second quick-disconnect fluid coupling is further provided herein for selectively providing a substantially straight fluid path within the coupling, comprising: a spout assembly for attachment to and fluid communication with a container comprising: a spout fitment including a cover having a first fluid opening therethrough for fluid communicating with the interior of the container, and a spout valve member having a second fluid opening and capable of rotating from a first position whereat there is an absence of a spout fluid path coupling the first and second fluid openings, to a second position whereat there is a presence of the spout fluid path coupling the first and second fluid openings.

The second quick-disconnect fluid coupling also includes a service-line connector comprising: a line fitting having a fitting fluid path therein, for attachment to and fluid communication with the fluid flow line, a first connector valve member having a third fluid opening and being capable of rotating from a third position to a fourth position, and further having a first engagement mechanism for engaging with the spout valve member in a manner that upon attachment of the service-line connector to the spout assembly, a spout-connector fluid path is formed between the second and third fluid openings, and in a further manner that rotation of the first connector valve member from the third position to the fourth position causes the spout valve member to rotate from the first position to the second position.

The service-line connector also includes a second connector valve member having a fourth fluid opening for fluid communicating therethrough with the fitting fluid path, the second connector valve member being capable of rotating from a fifth position whereat there is an absence of a connector fluid path coupling the third and fourth fluid openings, to a sixth position whereat there is a presence of a connector fluid path coupling the third and fourth fluid openings. The second connector valve member further capable of rotating to a seventh position and including a second engagement mechanism for engagement with the first connector valve member in a manner that rotation of the second connector valve member from the sixth position to the seventh position, causes the first connector valve member to rotate from the third position to the fourth position, whereat the spout fluid path, spout-connector fluid path and connector fluid path are coupled in series to form the substantially straight fluid path.

The service line-connector of the second quick-disconnect coupling further includes a second connector valve member having a fourth fluid opening for fluid communicating therethrough with said fitting fluid path, said second connector valve member being capable of rotating from a fifth position whereat there is an absence of a connector fluid path coupling said third and fourth fluid openings, to a sixth position whereat there is a presence of a connector fluid path coupling said third and fourth fluid openings. The second connector valve member is capable of rotating to a seventh position and including a second engagement mechanism for engagement with said first connector valve member in a manner that rotation of said second connector valve member from said sixth position to said seventh position, causes said first connector valve member to rotate from said third position to said fourth position, whereat the spout fluid path, spout-connector fluid path, and connector fluid path are coupled in series to form the substantially straight fluid path therethrough.

A second service-line connector is also provided herein for attachment to and fluid communication with a spout assembly and a fluid flow line, comprising: a line fitting having a fitting fluid path therein, for attachment to and fluid communication with the fluid flow line, and a first connector valve member having a first fluid opening and being capable of rotating from a first position to a second position, and further having a first engagement mechanism for engaging with a rotating valve member of the spout valve assembly in a manner that upon rotation of the first connector valve member from the first position to the second position causes the spout rotating valve member to rotate to an opened valve position for establishing a fluid connection between the spout assembly and the service line-connector through the first fluid opening.

The second service-line connector further includes a second connector valve member having a second fluid opening for fluid communicating therethrough with the fitting fluid path, the second connector valve member being capable of rotating from a third position whereat there is an absence of a connector fluid path coupling the first and second fluid openings, to a fourth position whereat there is a presence of the connector fluid path coupling the first and second fluid openings. The second connector valve member is further capable of rotating to a fifth position and including a second engagement mechanism for engaging with the first connector valve member in a manner that rotation of the second connector valve member from the fourth position to the fifth position, causes the first connector valve member to rotate from the first position to the second position.

Also provided herein is a second valve structure for selectively establishing a substantially straight fluid path from a proximal end to a distal end of the valve structure, comprising: a first stationary member situated at the proximal end of the valve structure and having a first fluid opening therethrough; and a first valve member situated closer to the distal end than the first stationary valve member, the first valve member having a second fluid opening therethrough and capable of movement with respect to the first stationary valve member from a first position whereat there is an absence of a first fluid path coupling the first and second fluid openings, to a second position whereat there is a presence of the first fluid path coupling the first and second fluid openings.

The second valve structure further includes a second valve member situated closer to the distal end than the first valve member distal end, the second valve member having a third fluid opening and capable of movement from a third position to a fourth position, the second valve member having a first engagement mechanism for engaging with the first valve member in a manner that a second fluid path couples the second and third fluid openings, and in a further manner that movement of the second valve member from the third position to fourth position causes the first valve member to move from the first position to the second position, thereby coupling in series the first and second fluid paths.

The second valve structure also includes a third valve member situated at the distal end, the third valve member having a fourth fluid opening and capable of movement from a fifth position whereat there is an absence of a third fluid path coupling the third and fourth openings, to a sixth position whereat there is an presence of the third fluid path coupling the third and fourth openings, the third valve member further including a second engagement mechanism for engaging with the second valve member in a manner that movement of the third valve member from the sixth position to a seventh position causes the second valve member to move from the third position to the fourth position, whereat the first, second and third fluid paths are coupled to form the substantially straight fluid path.

Additional objects, features and advantages of various aspects of the present invention will become apparent from the following description of its preferred embodiments, which description should be taken in conjunction with the accompanying drawings.

DETAILED DESCRIPTION OF THE PREFERRED EMBODIMENTS

Figure 1:
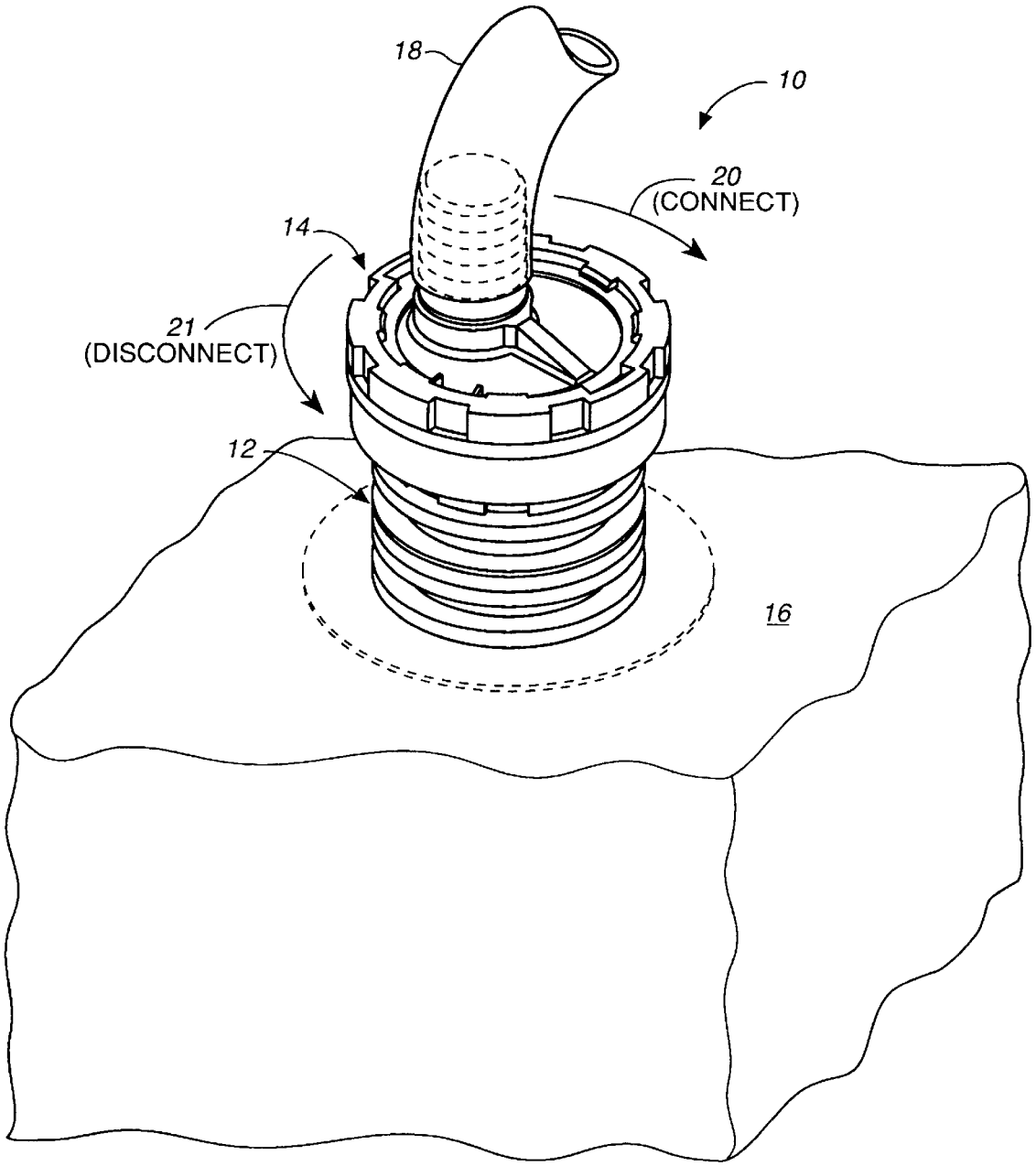
FIG. 1 shows a top, perspective view of a quick-disconnect fluid coupling as an example of a first embodiment of the invention.

Referring initially to FIG. 1, a perspective view of a quick-disconnect fluid coupling 10 as a first embodiment of the invention is shown. The quick-disconnect fluid coupling 10 comprises a spout assembly 12 attached to and fluidly coupled to a service-line connector 14. The spout assembly 12 is typically attached to and fluidly coupled with a container 16 that carries a fluid substance therein. The service-line connector 14 is typically attached to and fluidly coupled with a fluid flow line 18. The fluid flow line 18, in turn, can be used for communicating the fluid substance to a dispensing apparatus (not shown), for example.

As will be shown in more detail later, the quick-disconnect fluid coupling 10 of the invention has the advantage of providing an attachment of the service-line connector 14 to the spout assembly 12 and opening of their respective valves by a single, preferably clockwise, rotational movement 20 of an element of the service-line connector 14. In other words, at the end of such rotational movement 20, the service-line connector 14 would be securely attached to the spout assembly 12, and also their respective valves would be opened for communicating fluid through the coupling 10. Conversely, detaching the service-line connector 14 from the service-line connector 12 and the closing of their respective valves can be performed by a single, preferably counter-clockwise, rotational movement 21 of the same element of the service-line connector. This makes it easier for a user to fluidly connect and disconnect the fluid coupling 10.

Figure 2C:
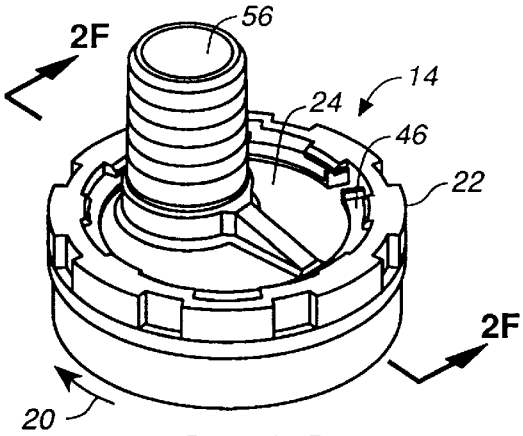
FIGS. 2C and 2D show assembled, top perspective views of the service-line connector as per the first embodiment of the invention in closed and opened valve positions, respectively.
Figure 2D:
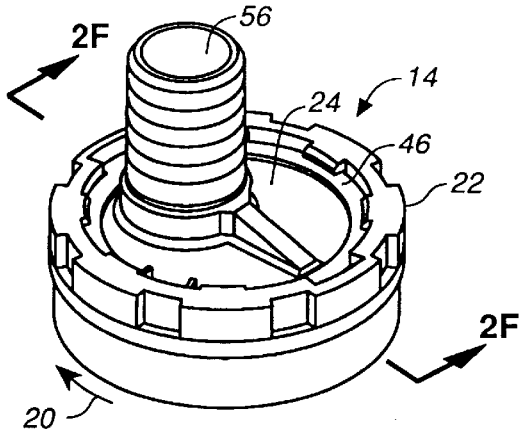
Figure 2A:
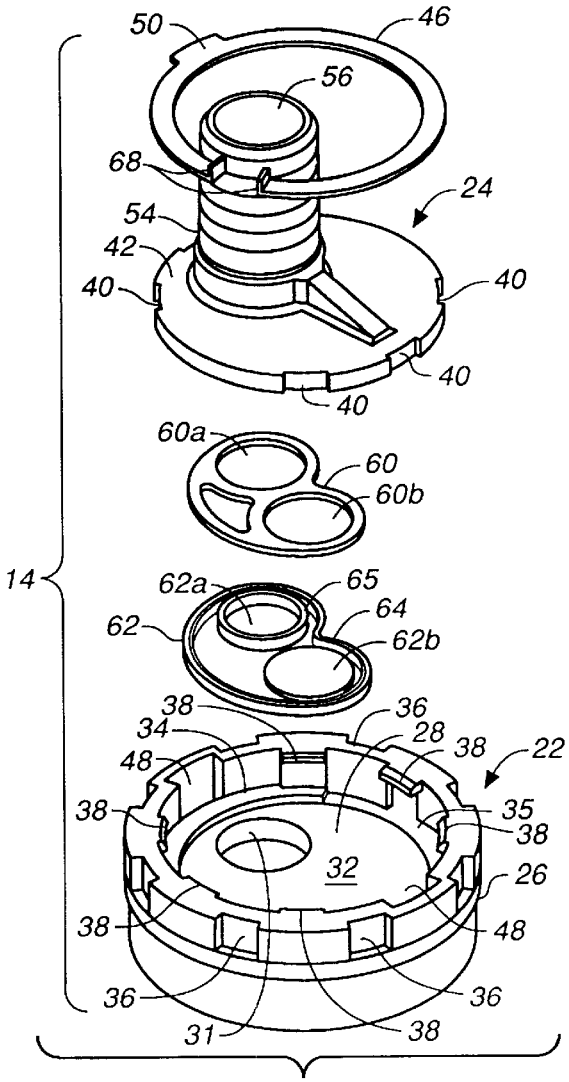
FIGS. 2A and 2B show disassembled top, and bottom perspective views of a service-line connector as per the first embodiment of the invention.
Figure 2B:
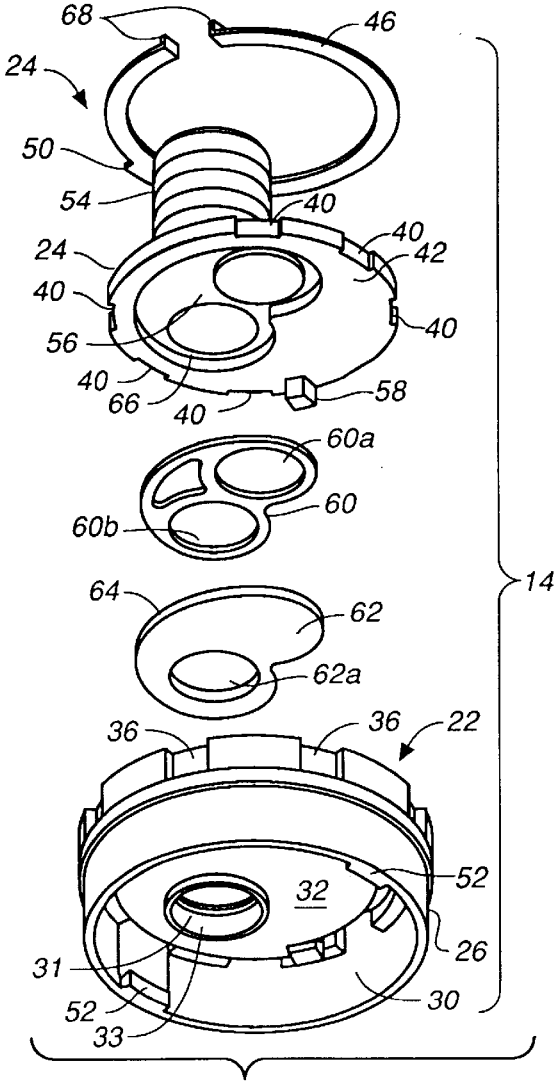

Referring now to FIGS. 2A–2B, disassembled top and bottom perspective views of the service-line connector 14 are shown. The service-line connector 14 comprises a connector valve member 22, a line fitment member 24, a sealing member or O-ring member 60, sealing member holding plate 62 and a locking ring 46. The connector valve member 22 is the element of the service-line connector 14 that undergoes the clockwise, rotational movement 20 relative to the line-fitment member 24 that results in a secured attachment of the service-line connector 14 to the spout assembly 12, and also the openings of their respective valves. Conversely, the connector valve member 22 is also the element that is caused to undergo the counter-clockwise rotational movement 21 relative to the line-fitment member 24 that results in a detachment of the service-line connector 14 and the spout assembly 12, and also the closing of their respective valves. The line fitment member 24 serves as a means for attaching and fluid coupling the service-line connector 14 to a fluid flow line 18. The sealing member 60 and holder 62 serves to provide a fluid seal between the connector valve member 22 and the line-fitment member 24 when the valve is closed. The locking ring 46 serves to provide rotatable attachment of the line-fitment member 24 to the connector valve member 22.

In detail, the connector valve member 22 preferably includes a substantially cylindrical housing 26 having opened upper and lower chambers 28 and 30 being separated from each other by a traversing wall 32. The traversing wall 32 includes a fluid opening 31 that extends therethrough from the upper chamber 28 to the lower chamber 30. The fluid opening 31 is situated to one side of the longitudinal axis of the cylindrical housing 26. The wall 32 further includes at its periphery a semi-annular raised step 34 that partially surrounds the central portion of the wall 32 at the housing upper chamber 28, preferably approximately 220 degrees of the wall circumference. The remaining periphery of the wall 32 includes a semi-annular slot 35, that preferably extends around 140 degrees of the wall circumference. The underside of the wall 32 further includes a rim 33 around the fluid opening 31 that extends downward into the lower chamber 30.

The connector valve member 22 further includes at the outside wall of the housing 26, a plurality of slots 36 surrounding the housing and spaced apart from each other at radial intervals. In this preferred embodiment, the slots 36 are situated coincident with the upper chamber 28 of the housing. The slots 36 facilitate gripping of the connector valve member 22 by the user for rotation of that member during attachment and detachment of the service-line connector 14 to and from the spout assembly 12. The slots 36 also reduce the overall mass of the service-line connector 14 and thereby makes it lighter in weight. Preferably, the slots are sufficiently spaced apart from each other so that the strength of the housing 26 is not substantially affected.

The inside wall of the connector valve member housing 26 at the upper chamber 28 includes a plurality of hooking members 38 extending radially into the upper chamber. In the preferred embodiment, there are six hooking members 38; a group of three situated symmetrically across from the other group of three, and each within a group radially spaced from each other at an angle of approximately 45 degrees. The inside wall of the housing 26 further includes a pair of indentations 48 symmetrically situated on opposite sides of the housing and in between the two groups of three hooking members 38. The indentations 48 are preferably radially spaced from a hooking member 38 at an angle of approximately 45 degrees. In this manner, the pair of extensions 48 and the six hooking members 38 are preferably equally spaced around the inside wall of the housing 26 at the upper chamber 28.

The inside wall of the housing 26 at the lower chamber 30 includes a pair of symmetrically opposed fingers 52, having ends that extend radially inward into lower chamber 30, and preferably situated at the bottom of the housing 26. The ends of the fingers 52 are preferably ramped (although not shown in FIG. 2C) so that they are slightly off of being horizontal and which causes the service-line connector 14 to urge against the spout assembly 12 during rotation of the connector valve member 22 in order to provide a more secure and fluid sealed attachment of the service-line connector 14 to the spout assembly 12, as will be explained in more detail later.

The line fitment member 24 includes a line fitting 54 formed on a substantially, circular disk-shaped base 42. The fitting 54 includes a fluid passageway 56 therethrough that extends through and from the base 42 to the opposing end of the fitting. It is this passageway 56 that fluid substance is communicated between the service-line connector 14 and the fluid flow line 18. The side of the line fitment base 42 includes a plurality of loading slots 40 that are situated around the base coincident with the orientation of the hooking members 38 around the inside wall of the housing 26 at the upper chamber 28. The underside of the base 24 includes a somewhat heart-shaped pocket 66 for receiving therein a complimentary-shaped sealing member 60 and holder 62. The lower opening of the fluid passageway 56 terminates within the pocket 66 and on one half of the heart-shaped indentation. At the other half of the pocket 66, the base 42 includes a circular platform **62*b* that extends a small distance downward from the underside of the base. The line-fitment member 24 further includes an indexing projection 58 that extends downward from the underside of the base 42**.

The service-line connector 14 further includes a sealing member 60 that preferably includes an integral pair of O-rings **60*a*–*b* that are combined to form a somewhat heart-shaped structure; complimentary-shaped with the pocket 66. The sealing member 60 is retained within a complementary-shaped holding plate or shoe 62. The holding plate 62 includes a sidewall 64 complimentary-shaped with the outline of the sealing member 60 such that the sidewall 64 retains it in place within the holder. The holding plate 62 further includes a raised platform 62*b* positioned and dimensioned to be inserted snugly into O-ring 60*b*, also for the purpose of retaining the sealing member 60 in place within the holding plate 62. The holding plate 62 further includes an opening 62***a* including a rim 65 there around that is positioned and dimensioned to be inserted snugly within O-ring 60*a*.

The service-line connector 14 further includes a flexible locking ring 46 that does not completely form a continuous ring, but terminates at a pair of lugs 68 that define a small space therebetween. The space between the lugs 68 preferably is about the same as the space between adjacent hooking members 38, since in the assembly of the service-line connector 14, the lugs abut the sides of adjacent hooking members. The locking ring 46 further includes an alignment tab 50 extending radially outward from the outer edges of the locking ring 46, and serves to provide proper placement of the ring on the assembled unit.

With reference to FIGS. 2A–2B, the discussion of the assembly of the service-line connector 14 will now follow. The sealing member 60 is placed within the holding plate 62, and both of them are placed within the complimentary-shaped pocket 66 of the line fitment member 24. The outside rim of the pocket 66 is preferably sized so that it can retain the holding plate 62 and sealing member 60 therein in a manner that prevents them from laterally moving during the operation of the valve. In this configuration, the O-ring 60*a* and the holder hole 62*a* are concentric with the opening of the fluid passageway 56 and held against the underside of the line-fitment base 42 around the periphery of the opening 56. Also in this configuration, the circular platform 62*b* is inserted snugly within the O-ring 60*b* and abuts the raise platform 62 of the holding plate 62.

Once the holding plate 62 and sealing member 60 are retained within the pocket 66 of the line fitment member 24, the line fitment member 24 is inserted into the upper chamber 28 of the connector valve member housing 22. This is accomplished by aligning the loading slots 40 of the line-fitment base 42 with the hooking members 38. In this manner, the line fitment base 42 is inserted past the hooking members until the underside of the base 42 sits on the semi-annular step 34. When this occurs, the indexing projection 58 extending from the underside of the line-fitment base 42 slides into the semi-annular slot 35. In this position, the top side of the base 42 is situated below the hooking members 38 and is free to rotate within the upper chamber about its longitudinal axis relative to the connector valve member 22; however, it is the connector valve member 22 that rotates and the line-fitment member 24 that is stationary during the operation of the valve. The rotation of the connector valve member 24 with respect to the line-fitment member 24 is, however, limited by the indexing projection 58 encountering the ends of the semi-annular slots 35.

Once the line fitment member 24 is properly placed within the upper chamber 28 of the housing 26, the locking ring 46 is then inserted to rotatably attach the line-fitment member 24 to the connector valve member 22. This is accomplished by squeezing the two lugs 68 of the locking ring 46 together, aligning the alignment tab 50 with the indentation 48 preferably the one closest to the fluid opening 31 (the other indentation 48 is merely provided to make the housing 26 symmetrical about its longitudinal axis), and dropping the ring into the upper chamber 28 until it bypasses the hooking members 38. By squeezing the locking ring 46, its outer diameter is reduced smaller than the distance between opposing hooking members 38; thereby allowing the locking ring to be inserted below the hooking members. The locking ring 46 is then allowed to expand by letting go of the lugs 68, which then causes the locking ring to slip under and against the bottom of the hooking members 38. The height of the hooking members 38 relative to the semi-annular step 34 should be small enough to provide a compressed retainment of the line-fitment member base 42 and locking ring 46; but not too small where it would prevent the line-fitment member 24 to rotate relative to the connector valve member 22.

Although the manner of assembling of the service-line connector 14 was described with the above particular order of steps, the order of the assembling steps is not critical to the invention, and can be performed in many other ways.

Figure 2E:
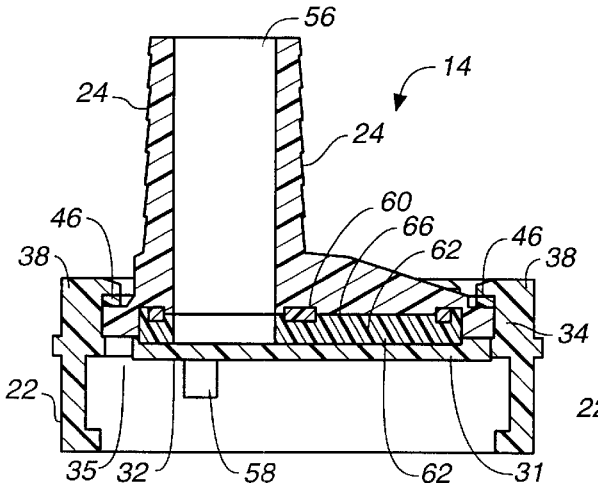
FIGS. 2E and 2F show cross-sectional view of the service-line connector as per the first embodiment of the invention across line 2E—2E and 2F—2F of FIGS. 2C and 2D, respectively.

Referring now to FIGS. 2C and 2E, an assembled, top perspective view and cross-sectional view across line 2E—2E of FIG. 2C of the service-line connector 14 in its closed valve position are shown. In its closed valve position, the connector valve member 22 is preferably at its counter-clockwise limit position. This limit results from the indexing projecting 58 abutting the clockwise end of the semi-annular slot 35. In the closed position, the fluid opening 31 of the connector valve member 22 does not overlap with the fluid passageway or opening 56 of the line fitment member 24; thereby not forming a connector fluid path through the service-line connector. In the closed position, a fluid seal is formed around fluid opening 56 in a manner that the traversing wall 32 covers the holding plate hole 62*a* and urges the O-ring 60*a* against the underside of the base around the fluid opening 56.

Figure 2F:
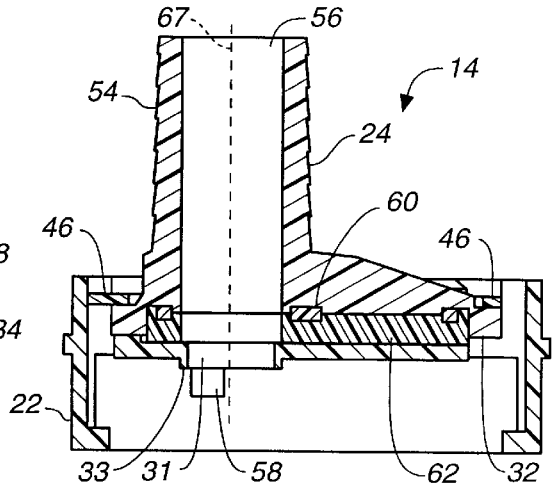

Referring now to FIGS. 2D and 2F, an assembled top perspective view and cross-sectional view across line 2F–2F of FIG. 2D of the service-line connector 14 in its opened valve position are shown. When the service-line connector valve is to be opened, the connector valve member 22 is rotated preferably in a clockwise rotation 20 until the indexing projection 58 abuts the counter-clockwise end of the semi-annular slot 35. In this position, the fluid opening 31 of the connector valve member 22 overlaps, and preferably aligns, with the fluid passageway or opening 56 of the line-fitment member 24, O-ring 60*a* and holding plate hole 62*a* to form a connector fluid path 67 through said openings.

Figure 3E:
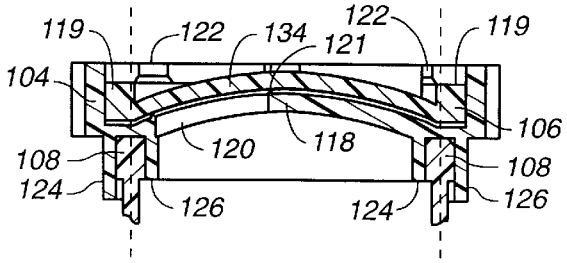
FIGS. 3E and 3F show cross-sectional view of the spout assembly as per the first embodiment of the invention across lines 3E—3E and 3F—3F of FIGS. 3C and 3D, respectively.
Figure 3F:
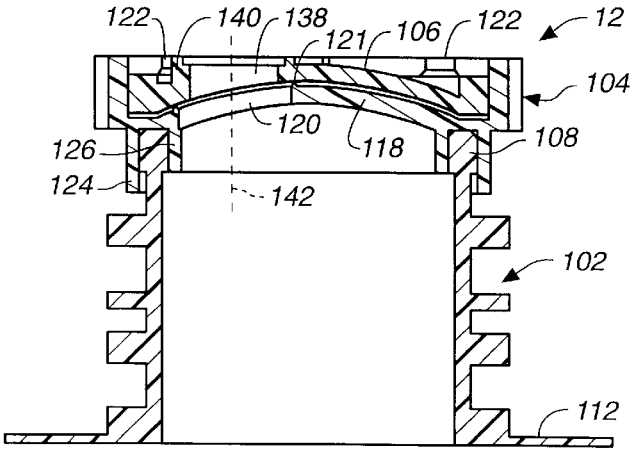
Figure 3C:
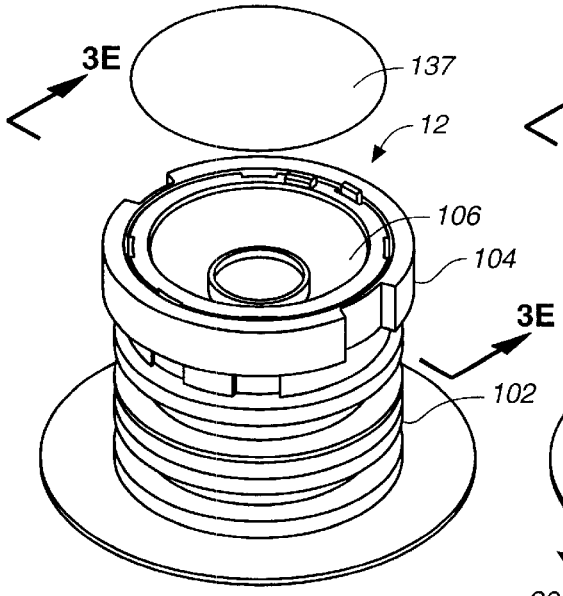
FIGS. 3C and 3D show assembled, top perspective views of the spout assembly as per the first embodiment of the invention in closed and opened valve positions, respectively.
Figure 3D:
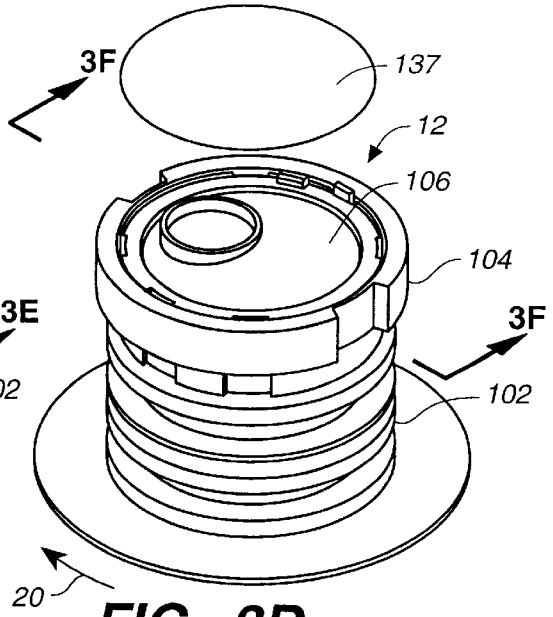
Figure 3A:
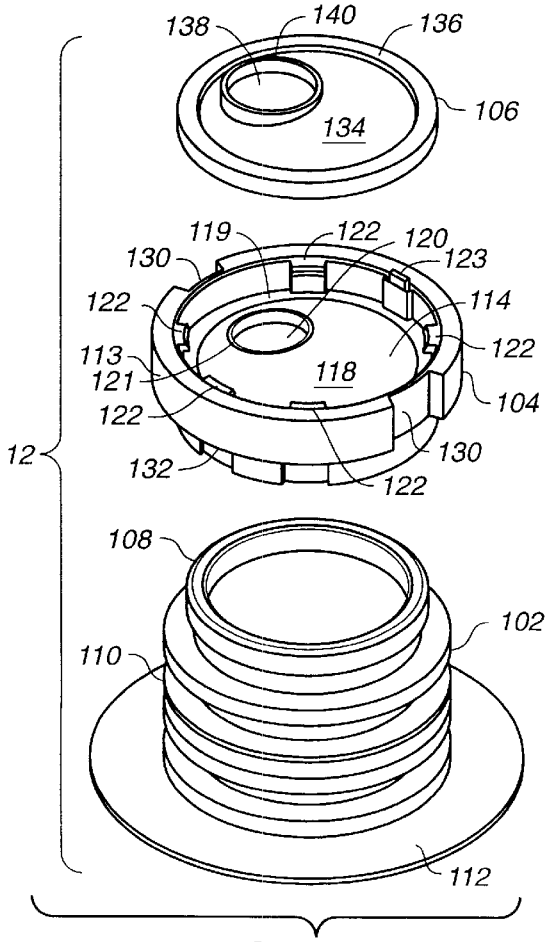
FIGS. 3A and 3B show disassembled, top and bottom perspective views of a spout assembly as per the first embodiment of the invention.
Figure 3B:
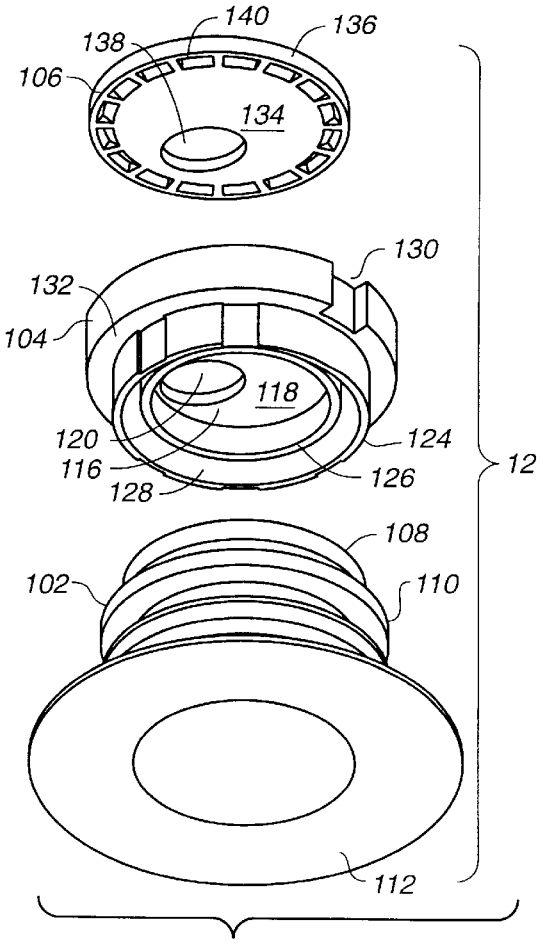

Referring now to FIGS. 3A–3B, disassembled top and bottom perspective views of the spout assembly 12 of the invention are shown. The spout assembly 12 comprises a fitment 102, a spout cover 104 and a spout valve member 106. The fitment 102 includes a top rim 108, a plurality of annular grooves 110 situated below the top rim 108 and a base ring 112 at the bottom of the fitment 112. A container 16 is typically attached to the spout assembly by way of the interior portion of the container 16 surrounding its opening being attached to the top surface of the base ring 112 (Shown in FIG. 1). The plurality of annular grooves 110 facilitate griping of the spout assembly 12 for better handling of the container 16 during shipping and installation. The top rim 108 is used for providing a secured attachment of the spout cover 104 to the fitment 102, as will be explained in more detail later.

The spout cover 104 preferably includes a substantially cylindrical housing 113 having an opened top chamber 114, an opened bottom chamber 116 and a traversing wall 118 separating the top chamber from the bottom chamber. The traversing wall 118 includes an annular flat surface 119 situated at the top-side of the wall and totally surrounds a central portion of the wall 118. The central portion of wall is concaved in a manner that its peak or vertex is situated at the wall's highest point. The concavity of the wall 118 improves the strength of the wall 118 and prevents it from unwanted flexing during the operation of the fluid coupling 10, but the wall 118 could alternatively be flat or convex if rigid enough. The central or concave portion of the wall 118 includes a fluid opening 120 therethrough extending from the top chamber 114 to the bottom chamber 112. The fluid opening 120 is situated off to one side of the central portion of the wall 118 in a manner that it is spaced apart from the longitudinal axis of the cylindrical housing 113.

The inside wall of the spout cover housing 113 at the top chamber 114 includes a plurality of hooks 122 extending radially into the top chamber, and radially spaced around the top chamber 114. The hooks 122 serve to retain the spout valve member 106 within the top chamber 114 of the spout cover 104. The inside wall of the spout cover housing 113 further includes an indexing slot 123 dimensioned and positioned to receive therein the indexing projection 58 of the service-line connector 14. A primary purpose of the indexing projection and slot is to prevent relative rotation between the service-line connector 14 and the spout assembly 12.

The lower chamber 116 of the spout cover 104 is bounded by an outside annular wall 124 and includes therein an inner annular wall 126 coaxial with wall 124 that extends a distance downward from the underside of traversing wall 118. An annular space 128 is defined between the two annular walls 124 and 126. The face of annular wall 124 that situated within the annular space 128 may contain a plurality of ridges (not shown) which serve to prevent the spout cover 104 from rotating with respect to the spout during operation of the valve.

The outside wall of the spout cover housing 113 includes a pair of recesses 130 situated on opposing sides of the housing. These recesses 130 are dimensioned and positioned to receive therethrough the fingers 52 of the service-line connector 14 when the connector is initially attached to the spout assembly 12. The outside wall of the housing 113 coincident with the upper chamber 114 is of greater diameter than that of the outside annular wall 124 coincident with the lower chamber 116. As a result, a ledge 132 is defined below the upper outside wall of the housing 113.

The spout valve member 106 comprises a substantially disk-shaped structure that includes a concave wall 134 surrounded by an annular raised rim 136. The curvature of the concave wall 134 is preferably the same as that of the convex wall 118. The wall has a fluid opening 138 therethrough and situated off to one side of the disk-shaped structure such that the axis of the fluid opening 138 does not coincide with the central axis of the disk-shaped structure. The fluid opening 138 includes a rim 140 that extends upward away from the concave wall. The rim 140 is preferably ramped in order for the top surface of the rim 140 to be substantially horizontal, and in this way, the ramp compensates for the rim being disposed on curved surface, i.e. concave wall 134.

The discussion of the assembly of the spout assembly 12 will now follow. The spout valve member 106 is then inserted into the top chamber 114 of the spout cover 104. With the spout valve member 106 oriented such that the fluid opening rim 140 faces away from the spout cover 104, the rim 136 is axially aligned with the top chamber 114 and sits on the plurality of hooks 122. Then the spout valve member 106 is pressed against the plurality of ribs 122 until they flex and allow the spout valve member 106 to snap into the upper chamber. Once this occurs, the annular rim 136 of the spout valve member 106 is disposed on the annular flat surface 119 of the spout cover. The top surface of the annular rim 136 is situated under and against the plurality of hooks 122; thereby retaining the spout valve member 106 within the top chamber 114. The space between the hooks 122 and the annular flat surface 119 should be small enough that the spout valve member is retained therein in a relatively tight fit so that it does not easily move during non-operational times of the valve. Yet, that space should not be too small that it prevents the spout valve member 106 from rotating.

The spout cover 104 is then attached to the fitment 102. This is performed by aligning the spout cover 104 over the fitment 102 in a manner that the rim 108 of the fitment 102 is aligned with the annular space 128 of the spout cover. The spout cover 104 is then pressed against rim 108 so that the rim 108 is inserted into the annular space 128. The spout cover 104 remains securely attached to the fitment 102 by means of frictional forces of the rim 108 against both annular walls 124 and 126. As discussed earlier, the side of wall 124 that is situated within annular space 128 may have a plurality of small ridges (not shown) that are aligned in a manner that it prevents rotation of the spout cover 104 relative to the fitment 102. This helps in keeping the spout cover 104 fixed while the spout valve member 106 is rotating during the operation of the spout valve.

Although the manner of assembling of the spout assembly 12 was described with a particular order of steps, the order of the assembling steps is not critical to the invention, and can be performed in many other ways.

Referring now to FIGS. 3C and 3E, an assembled top perspective view and cross-sectional view across line 3E—3E of FIG. 3C of the spout assembly 14 in its valve closed position are shown. The spout assembly 12 is initially assembled in its closed valve position. Since the spout assembly 12 does not have closed and open position indicators or stops such as with the service-line connector 14 (i.e. the indexing projection abutting either the clockwise or counter-clockwise ends of semi-annular slot 35), the initial assembly of the spout requires that the spout valve member 106 be precisely placed relative to the spout cover 104 that fluid opening 138 coincides with the fluid opening 31 of the connector valve member 22 when its in the closed position. In the closed position, the fluid opening 120 of the spout cover 104 does not overlap with the fluid opening 138 of the spout valve member; thereby not forming a spout connector path through the spout assembly. In the opened position, a sealing ridge 121 provided on the upper surface of the spout cover wall 118 around the fluid opening 120 produces a fluid seal closure. The sealing ridge 121 is urged against the underside of the spout cover 106 and slides there across between opened and closed positions.

Referring now to FIGS. 3D and 3F, an assembled, top perspective view and cross-sectional view across line 3F—3F of FIG. 3D of the spout assembly 12 in its opened valve position are shown. During the opening of the spout assembly valve, the spout valve member 106 is engaged with the connector valve member 22 in a manner that they both rotate with each other. Therefore, when the connector valve member 22 rotates from its closed valve position to its opened valve position, it causes the spout valve member to also rotate from its closed valve position to its open valve position; the rotation is preferably clockwise. In the opened-valve position, the fluid opening 138 of the spout valve member 106 overlaps, and preferably aligns, with the fluid opening 120 of the spout cover 104; thereby forming a spout fluid path 142 through said openings.

The spout assembly 12 may further include a pealable sheet 137 that is attached by an adhesive to an outside top edge of the spout valve member 12 in order to cover the fluid opening 138 and the surface area of the spout valve member 106 around this opening. This sheet 137 prevents contamination of the fluid opening 138 during handling and shipping of the fluid coupling assembly. The end user removes the sheet 137 by breaking the adhesive seal by hand.

Figure 4A:
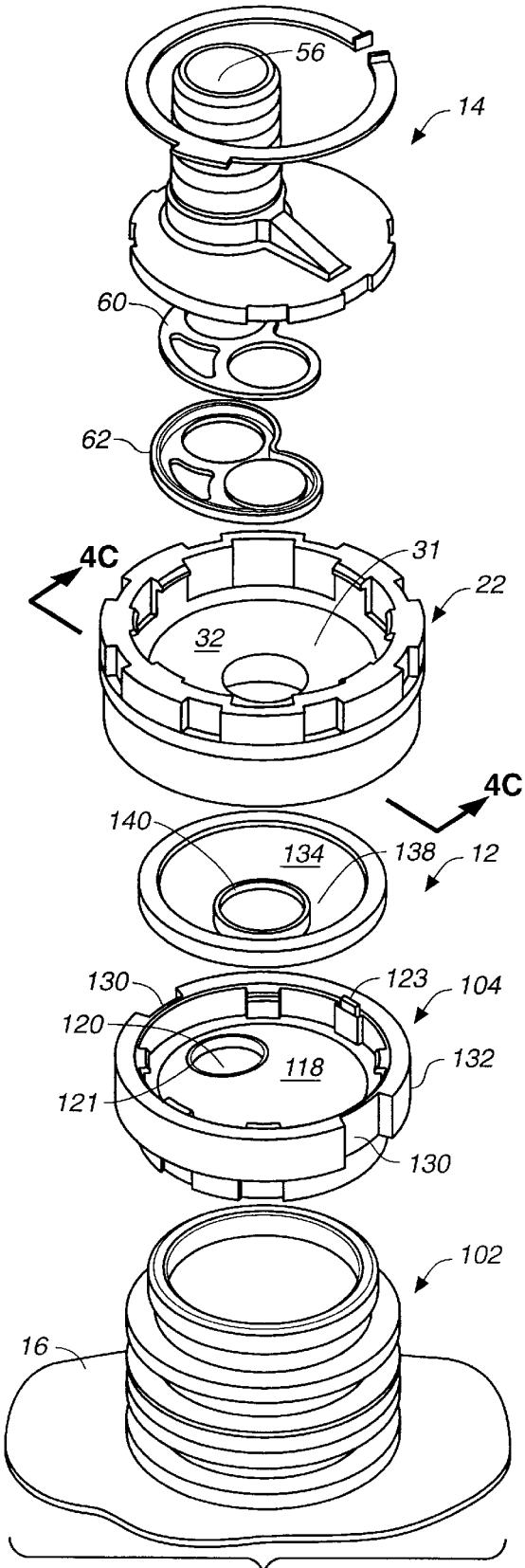
FIGS. 4A and 4B show disassembled, top perspective views of the quick-disconnect fluid coupling of the first embodiment of the invention in closed and opened valve positions, respectively.
Figure 4B:
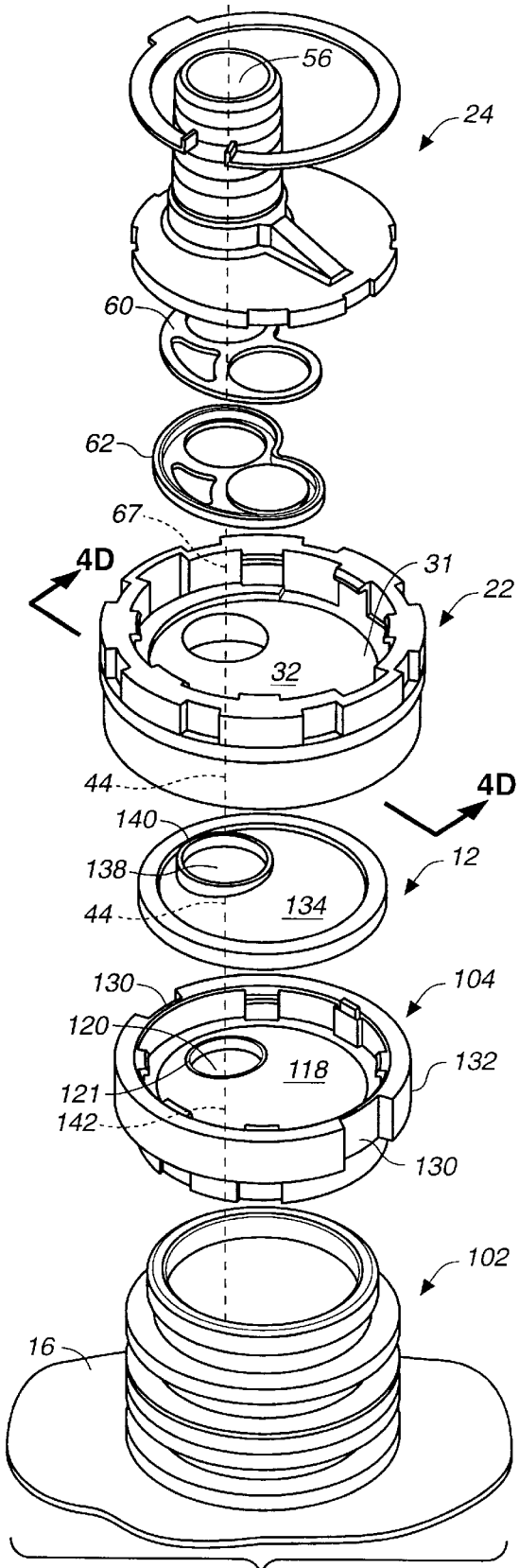
Figure 4C:
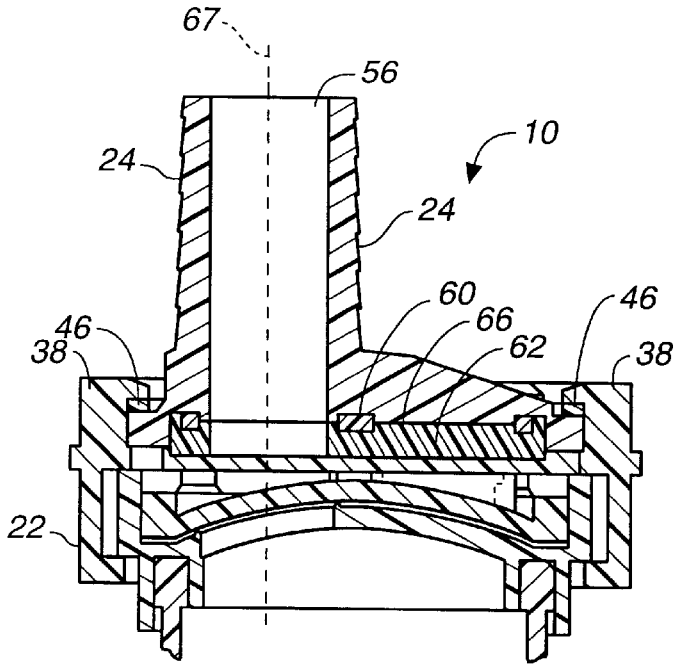
FIGS. 4C and 4D show a cross-sectional view of the quick-disconnect fluid coupling of the first embodiment of the invention across lines 4C—4C and 4D—4D of FIGS. 4A and 4B, respectively.

Referring now to FIGS. 4A and 4C, a disassembled, top perspective view and a cross-sectional view across line 4C—4C of FIG. 4A of the quick-disconnect fluid coupling 10 of the invention in a non-fluid communicating position are shown. When the service-line connector 14 and the spout assembly 12 are to be mated, both the service-line connector and the spout assembly are in their respective closed valve position. Also when the service-line connector 14 is mated with the spout assembly, the indexing projection 58 (not shown in FIGS. 4A–4B) extending downward from the bottom of the line-fitment member 24 is aligned with the indexing slot 123 of the spout cover 104. When the indexing tab 58 and slot 123 are aligned, the fluid openings 31 and 138 of the connector and spout valve members, respectively, are also aligned. Also in this orientation, the pair of fingers 52 (not shown in FIGS. 4A–B) of the connector valve member 22 are also aligned with the pair of recesses 130 of the spout cover 104.

Once the service-line connector 14 and the spout assembly 12 are properly aligned for attachment, the connector valve member 22 is slid over the spout cover 104 so that the ends of the fingers 52 slides downward through the recesses 130 of the spout cover 104. This movement also causes the indexing projection 58 to be inserted into the indexing slot 123. This movement further causes the rim 33 (not shown in FIG. 4A) around the fluid opening 31 of the connector valve member 22 to abut with the rim 140 around fluid opening 138 of the spout valve member 106. In this position, the rims 33 and 140 are aligned and against with each forming a closed spout-connector fluid path within the rims.

Figure 4D:
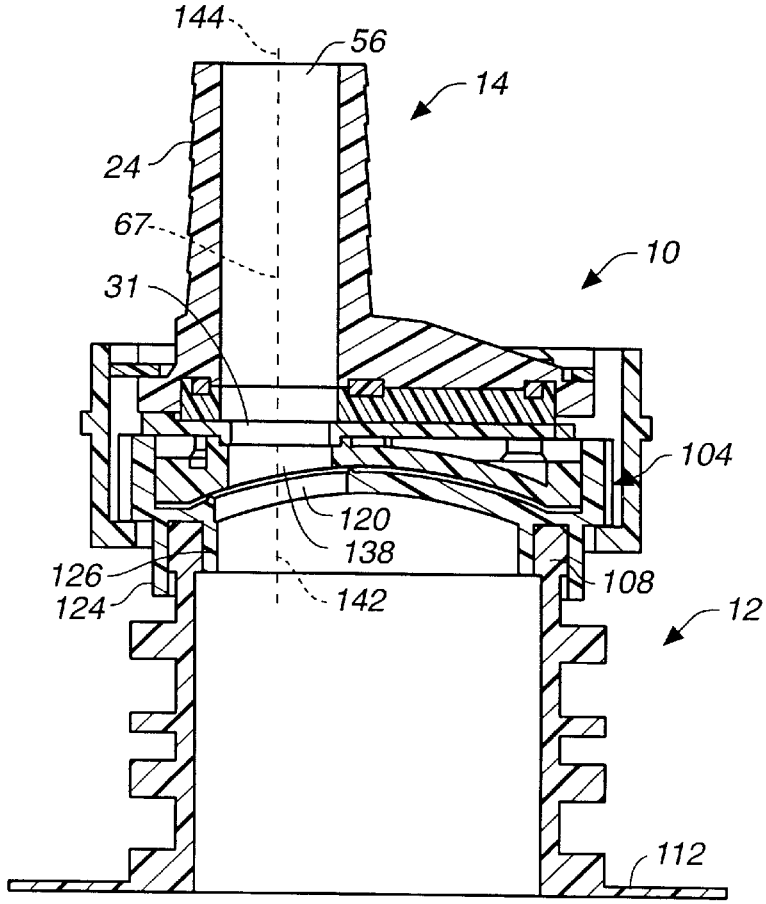

Referring now to FIGS. 4B and 4D, a disassembled top perspective view and a cross-sectional view across line 4D—4D of FIG. 4A of the quick-disconnect fluid coupling 10 of the invention in a fluid communicating position are shown. Once the service-line connector 14 is in the position where the rims 33 and 140 abut and the fingers 52 are situated at approximately the same level as ledge 132, the connector valve member 22 is caused to rotate, preferably in the clockwise direction. This rotation causes the ends of the fingers 52 to slide under and grab the ledge 132. Since the ends of the fingers 52 are slightly inclined in a direction opposite the direction of rotation, as the connector valve member 22 is rotating, the position of the ledge on the ramped ends move further up the incline. This causes the connector valve member 22 to move closer to the spout valve assembly, and specifically, causes compression of the aligned rims 33 and 140 against each other such that a fluid seal is formed therebetween.

Rotation of the connector valve member 22 is coupled with the spout member 106 by the rim 33 of the connector valve member 22 being interlocked with an inside surface of the opening 138 of the spout member 106. This causes the spout valve member to rotate with the connector valve member. The rotation of both the connector and spout valve members 22 and 106 continues until the indexing projection 58 abuts the counter-clockwise end of semi-annular slot 35. In this position, both valves of the service-line connector 14 and the spout assembly 12 are opened.

FIG. 4B shows a disassembled, perspective view of the fluid coupling 10 in a spatial orientation wherein the valves of the service-line connector 14 and the spout assembly 12 are opened. Once the connector and spout valve members 22 and 106 are rotated to the position where the indexing projection 58 abuts the counter-clockwise end of semi-annular slot 35, the fluid opening 31 of the connector valve member and the fluid opening or passageway 56 of the line fitment 24 align with each other, thereby forming connector fluid path 67. Simultaneous with alignment of fluid openings 31 and 56, the fluid opening 138 of the spout valve member 106 aligns with the fluid opening 120 of the spout cover 104, thereby forming spout fluid path 142. Since there is formed a spout-connector fluid path between the fluid openings 31 and 138 of the connector and spout valve members, the spout and connector fluid paths are coupled in series by way of the spout-connector fluid path to form a substantially straight fluid path 144 within the fluid coupling 10. In the preferred embodiment, a rotation of about 138 degrees of the connector valve member 22 causes the service-line connector and the spout assembly to move from their closed valve position to its opened valve position.

For detaching the service-line connector 14 from the spout assembly 12, the connector valve member 22 is rotated in a preferably counter-clockwise direction, until the indexing projection 58 abuts the clockwise end of the semi-annular slot 35. In this position, the pair of fingers 52 of the connector valve member 22 are aligned with the corresponding pair of recesses 130 on the spout cover 104. During this counter-clockwise rotation of the connector valve member 22, the spout valve member 106 is caused to rotate with the connector valve member by the force of the connector valve member rim 33 against the spout valve member rim 140. Once the fingers 52 are aligned with the recesses 130, the position of the connector and spout valve members 22 and 106 are such that service-line connector fluid openings 31 and 56 and spout assembly fluid openings 120 and 138 do not respectively overlap; thereby not forming a connector and spout fluid path through the service-line connector and spout assembly, respectively. The fingers 52 being aligned with the recesses 130, the service-line connector 14 can be removed from the spout assembly 12 by sliding the fingers through the recesses, away from the spout assembly.

An advantage of the substantially straight fluid path 142 is that it provides relatively undisturbed fluid flow through the coupling 10. The relatively undisturbed fluid flow achieved with this coupling allows for increased fluid flow rates therethrough. This is particularly useful for dispensing of relatively thick fluid substance. A further advantage of the substantially straight fluid path 142 is that it helps in preventing obstruction of the fluid path due to solid particles in the fluid substance, since these particles need not zig-zag around twisted fluid paths. This is particularly useful for condiments that include therein food particles, such as relishes or meat and/or vegetable containing pasta sauces.

A further advantage of the quick-disconnect fluid coupling 10 of the invention is its capability of shearing large particles that may be caught in between of the respective fluid openings 120, 138 and 31 and 62*a* of the coupling. During rotation of the connector valve member 22 when the valve is being closed, the edges of fluid opening 31 at the top surface of wall 32 of the connector valve member slides tangentially against the edges of fluid opening 62*a* at the bottom of the holding plate 62. In this manner, both edges act together to shear any solid particles that are caught between fluid opening 31 and 62*a*. This shearing function is also present in the spout assembly, since the edges of fluid openings 120 and 138 slides tangentially against each other during the rotation of the spout valve member 106. This is particularly useful in dispensing condiments, where large food particles may be caught between fluid openings 120 and 140 and/or 31 and 62*a*.

Figure 5:
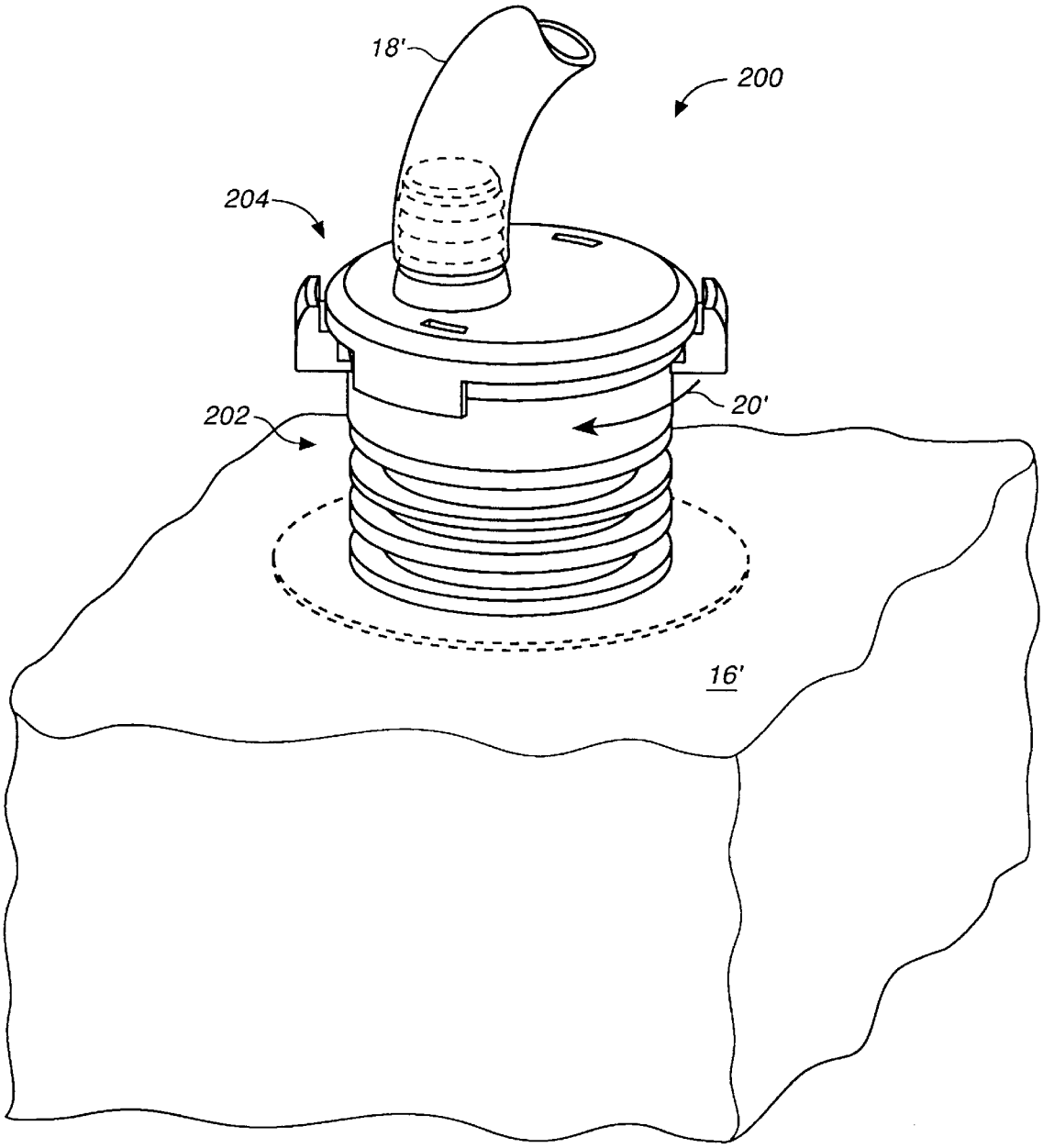
FIG. 5 shows a top, perspective view of a quick-disconnect fluid coupling as an example of a second embodiment of the invention.

Referring now to FIG. 5, a top perspective view of a quick-disconnect fluid coupling 200 of a second embodiment of the invention is shown. This fluid coupling 200 is similar to fluid coupling 10 as previously discussed, and therefore, reference numbers for elements in fluid coupling 200 will be the same for similar elements in fluid coupling 10, but with the addition of a prime associated with the numbers. The detail discussions of such similar elements of fluid coupling 200 will not follow, since these were discussed earlier with respect to fluid coupling 10.

The quick-disconnect fluid coupling 200 comprises a service-line connector 204 attached to and in fluid communication with spout assembly 202. The spout assembly 202 is typically attached to a container 16' for selectively dispensing fluid substance contained therein. The service-line connector 204 is typically connected to a fluid flow line 18' for transmission thereto of fluid substance. The fluid coupling 200 is useful for dispensing fluid substance from the container 16' to the fluid flow line 18' by way the spout assembly 202 and the service-line connector 204. As with quick-disconnect fluid coupling 10, an attachment of the service-line connector 204 to the spout assembly 202 and the opening of their respective valves is provided with a single rotational movement 20' of an element of the service-line connector, preferably in a clockwise direction.

Figure 6A:
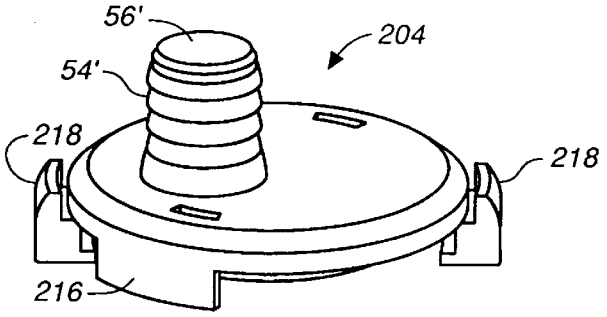
FIGS. 6A–6C show assembled top perspective, disassembled top perspective, and disassembled bottom perspective views, respectively, of a service-line connector as per the second embodiment of the invention.
Figure 6B:
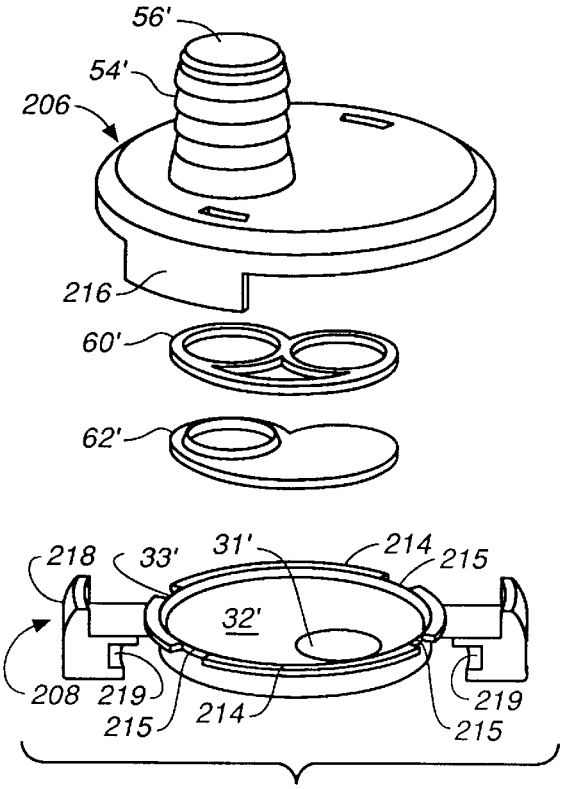
Figure 6C:
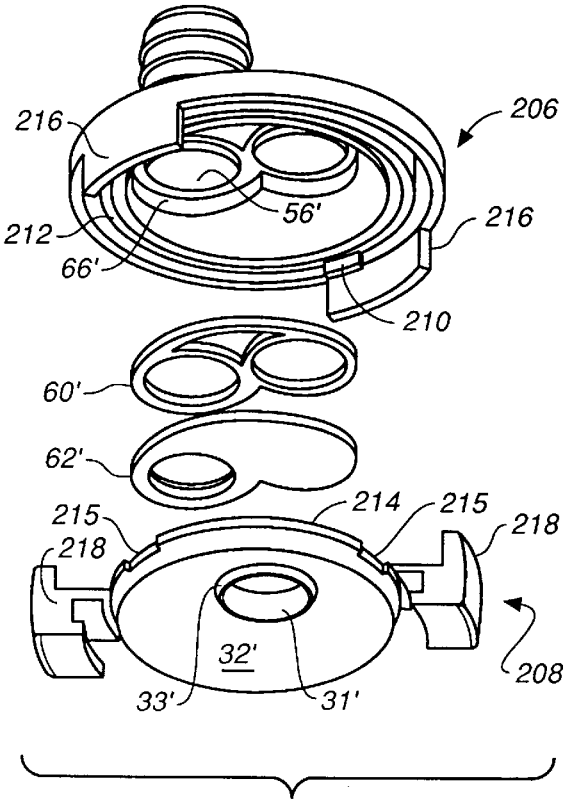

Referring to FIGS. 6A–6C, assembled top perspective, disassembled top perspective and disassembled bottom perspective views of service-line connector 204 are shown. The service-line connector 204 comprises a line-fitment member 206 including a fitting 54' for attachment to and fluid communication with fluid flow line 18', and a connector valve member 208 for attachment of the service-line connector 204 to the spout assembly 202, and for the operation of their respective valves. The service-line connector 204 may further include a sealing member 60' retained in a holding plate 62'; both of which are, in turn, retained in complimentary-shaped pocket 66' on the underside of line-fitment member 206.

The line-fitment member 204 includes a plurality of hooking members 210 (one shown in FIG. 6C) that are radially spaced around the periphery of the underside of line-fitment member. The line-fitment member 206 also includes on its underside an annular track 212 situated above the hooking members 210. The hooking members 210 and the annular track 212 work in combination to retain the connector valve member 208 rotatably attached to the underside of the line-fitment member 206 wherein its rotation is guided by the annular track. The connector valve member 208 includes a pair of semi-annular rim extensions 214 that includes a plurality of loading slots 215 for the purpose of bypassing the hooking members 210 so that the semi-annular rim extension can be mounted on the annular track 212.

The line fitment member 204 further includes a pair of rotation-limiting members 216 that extends downward from the periphery of the line-fitment member 206 below its underside. These walls 216 work in conjunction with a pair of fingers 218 extending radially outward from the connector valve member 208 for providing limits on the rotation of the connector valve member. As will be explained in more detail later, these fingers 218 include a groove 219 that serve to provide a secured attachment of the service-line connector 204 to the spout assembly 202.

As with the quick-disconnect fluid coupling 10, the service-line connector 204 includes a connector valve member fluid opening 31' through wall 32' and including a rim 33' extending downward from the underside of the connector valve member 208. Likewise, the fitting 54' also has a fluid passageway or opening 56' therethrough. As with fluid coupling 10, rotation of the connector valve member 208 to a first position causes fluid openings 31' and 56' to overlap or preferably align for providing a connector fluid path through the service-line connector, and to a second position causes fluid openings 31' and 56' to not overlap, thereby not providing such connector fluid path.

Figure 7A:
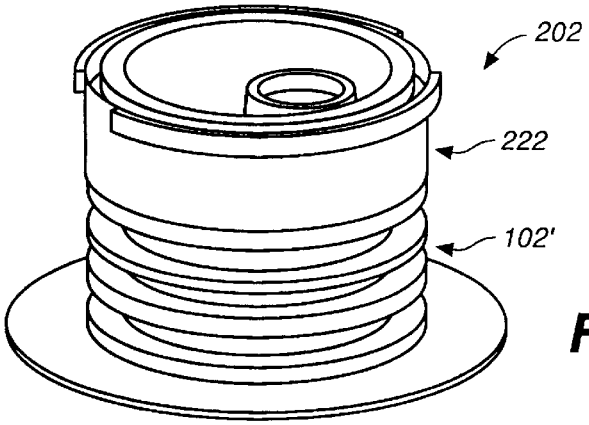
FIGS. 7A–7C show assembled top perspective, disassembled top perspective, and disassembled bottom perspective views, respectively, of a spout assembly as per the second embodiment of the invention.
Figure 7B:
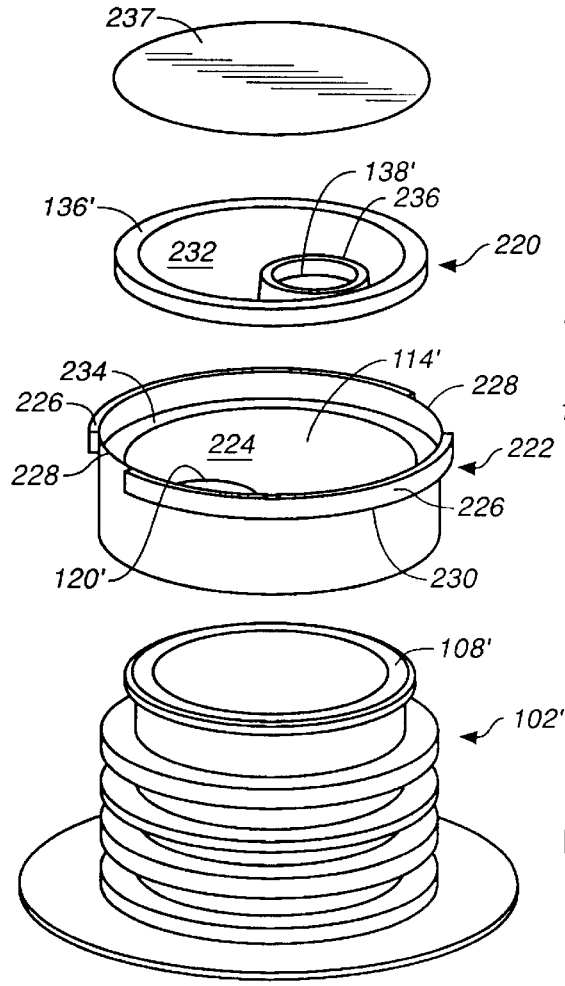
Figure 7C:
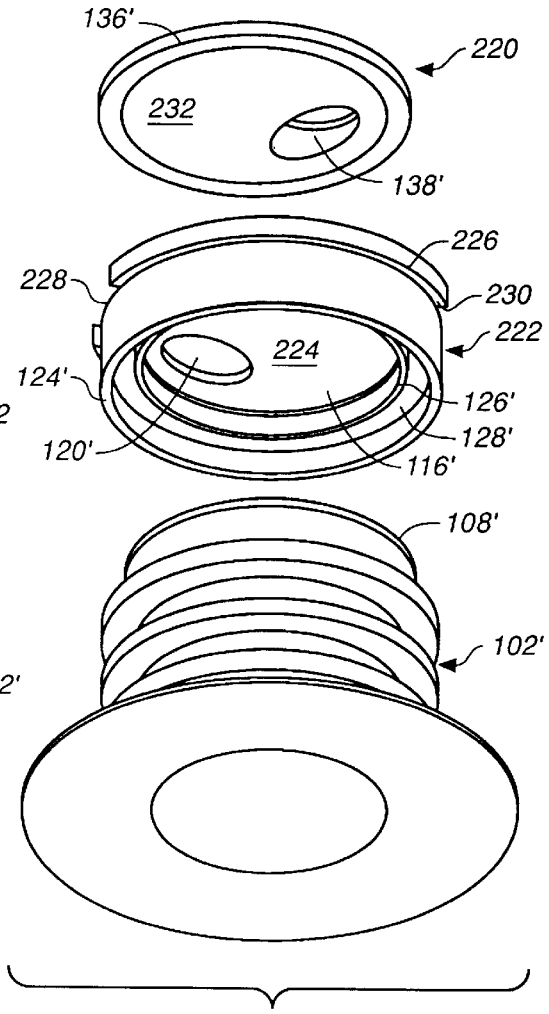

Referring to FIGS. 7A–7C, assembled top perspective, disassembled top perspective, and disassembled bottom perspective views of the spout assembly 202 are shown. The spout assembly 202 includes a fitment 102', a spout cover 222 and a spout valve member 220. The spout cover 222 includes an opened upper and lower chambers 114' and 116' being separated from each other by traversing wall 224. Traversing wall 224 includes a central portion thereof being concaved in shape and having its concavity in a manner that its vertex is situated at the lowest point of the curvature. As per wall 118 of the fluid coupling 10, the concavity of the wall 224 improves its strength and prevents the wall from easily flexing during the operation of the coupling. The wall 224 also includes a fluid opening 120' having an longitudinal axis thereof non-coaxial with the longitudinal axis of the spout cover 222. The outside periphery of the wall 224 at its top side includes a substantially horizontal annular shelf 234.

The spout cover 222 includes concentric, semi-annular walls 124' and 126' extending downward from the wall 224 into the lower chamber 116' that define an annular space 128' therebetween for receiving in a friction fit manner the top rim 108' of the fitment 102'. The spout cover 222 further includes a pair of semi-annular rim extensions 226 that partially surrounds the top rim of the spout cover and defines a pair of recesses 228 between the respective ends of the extensions. Each of the rim extensions 226 extends downward a distance from the top of the spout cover 222 and each includes a lower ledge 230.

The spout valve member 222 includes a concave wall 232 having a fluid opening 138' therethrough and being surrounded by a rim 136'. The concavity of wall 232 is preferably the same as the concavity of wall 224 of the spout cover 222; that is, having substantially the same curvature with an apex at the lowest point on the curvature. The wall 232 further includes a rim 236 surrounding fluid opening 138' that extends upwards. The spout valve member is dimensioned to be received within the upper chamber 114' of the spout cover 222 in a manner that the rim 136' sits on annular surface 234 and is retained therein by frictional force of the outside face of the rim 136' held against the inside wall of the spout cover 222 at the upper chamber 114'. In this position, the spout valve member wall 232 sits against and substantially tangential to wall 224 of the spout cover 222. The spout valve member 220 is initially retained in the upper chamber 114' in its closed position.

The spout assembly 202 may further have during its initial shipping a pealable sheet 237 that is attached to the spout valve member 220 in a manner that the fluid opening 138' and the area around it is covered. This sheet 237 prevents contamination of the fluid opening 138' during handling and shipping of the quick-disconnect fluid coupling 200.

Figure 8A:
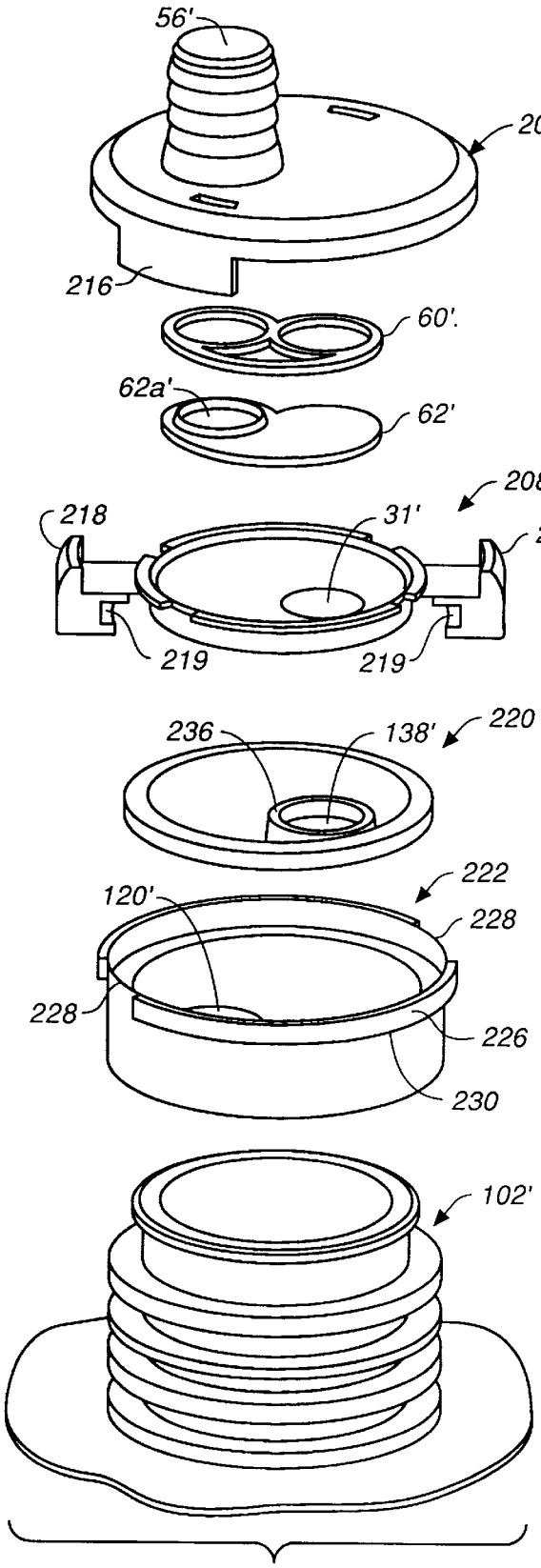
FIGS. 8A–8B show disassembled, top perspective views of the quick-disconnect fluid coupling of the second embodiment of the invention in closed and opened valve positions, respectively.
Figure 8B:
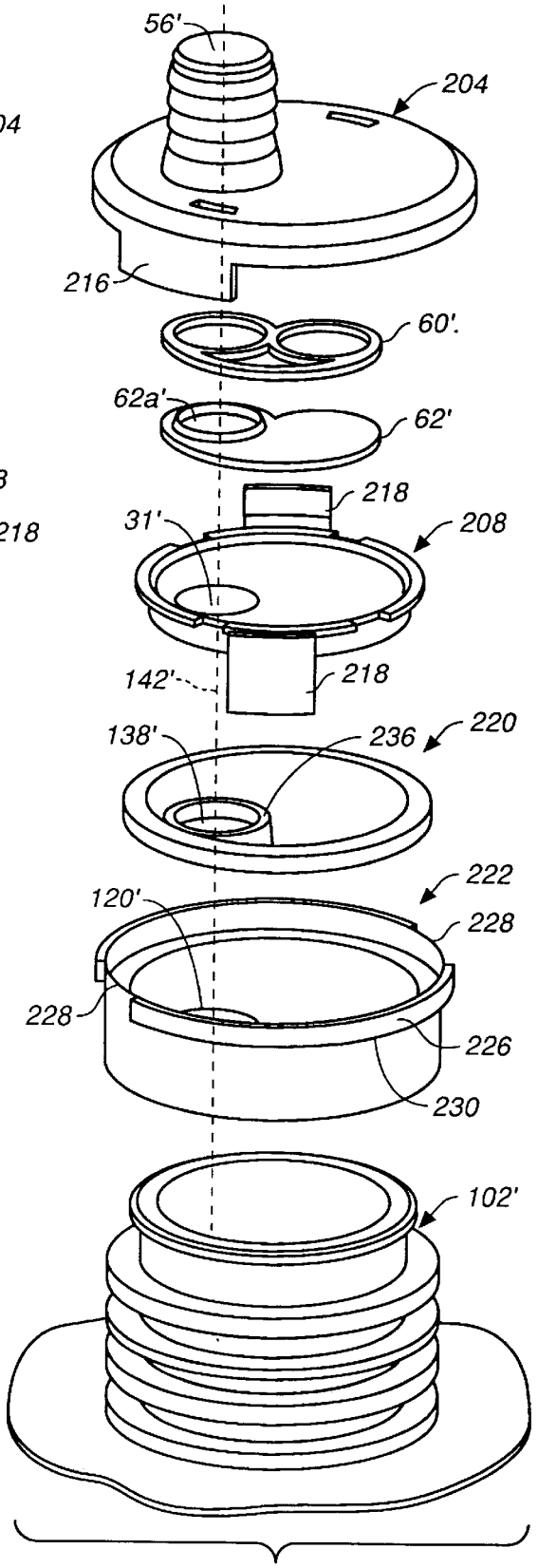

Referring now to FIGS. 8A–8B, disassembled top perspective views of the quick-disconnect fluid coupling 200 of the invention in the closed valve and opened valve positions, respectively, are shown. Just prior to attaching the service-line connector 204 to the spout assembly 202, both the connector 204 and spout 202 are in their respective closed-valve position. Specifically, the spout valve member 220 is oriented with respect to the spout cover 222 such that their respective fluid openings 138' and 120' do not overlap thereby not forming a spout fluid path therethrough. The connector valve member 208 is also oriented with respect to the line-fitment member 206 such that their respective fluid openings 31' and 56' do not overlap; thereby not forming a connector fluid path therethrough.

The connector valve member 208 is then aligned with respect to the spout valve member 220 such that their respective fluid openings 31' and 138' are aligned with each other. In this position, the pair of fingers 218 of the connector valve member 208 are also aligned with the pair of recesses 228 of the spout cover 222.

The service-line connector 204 is then moved towards the spout assembly 202 such that the fingers 218 slides through the recesses 228. In this position, the rim 33' surrounding connector valve member fluid opening 31' (not shown in FIGS. 8A–8B) comes in alignment contact with rim 236 surrounding fluid opening 138' of the spout valve member 220.

The connector valve member 208 is then rotated, preferably in the clockwise direction, in a manner that the grooves 219 of the fingers 218 slide over the semi-annular rim extensions 226 of the spout cover 222. The lower ledges of the grooves 219 are preferably ramped in a manner that when the connector valve member 208 is rotated clockwise, the rim 33' of the connector valve member is urged against the rim 236 of the spout valve member 220 such that a fluid sealed spout-connector fluid path is formed between the two rims. During the rotation of the connector valve member 208, the force of the connector rim 33' against the spout rim 236 causes the spout valve member 220 to rotate with the connector valve member. The connector valve member 208 is rotated until the fingers 218 abut the edges of the rotation-limiting members 216 of the line-fitment member 206. When this occurs, the quick-disconnect fluid coupling 200 is in the fluid communicating position. In the preferred embodiment, the connector valve member 208 is rotated approximately 138 degrees about its longitudinal axis from the closed to the opened position, and vice-versa.

FIG. 8B shows the spatial orientation of the quick-disconnect fluid coupling 200 in fluid communication. In this fluid communicating position, the fluid openings 31' and 56' of the connector valve member 208 and the line-fitment member 206, overlap, and preferably are aligned. When this occurs, a connector fluid path is formed through fluid opening or passageway 56' and fluid opening 31'. Also in the fluid communicating position, the fluid openings 138' and 120' of the spout valve member 220 and spout cover 228, respectively, overlap and preferably align. When this occurs, a spout fluid path is formed through fluid openings 138' and 120'. Since there is a spout-connector fluid path between fluid openings 138' and 31', the connector and spout fluid paths are fluidly coupled in series by way of the spout-connector fluid path to form a substantially straight fluid path 142' through the fluid coupling 200.

As with the quick-disconnect fluid coupling 10, the substantially straight fluid path 142' provides the advantages of providing increased fluid flow rates and increased resistance to food particle obstruction in the fluid path 142'; both advantages of which are particularly useful in dispensing of condiment products. The quick-disconnect fluid coupling 200 further has the advantage of providing attachment of the service-line connector 204 to the spout assembly 202 and opening of their respective valves by the single rotational movement of the connector valve member 208. And a further advantage is that a relatively small rotation of the connector valve member 208 is required to open the valves of the fluid coupling, i.e. about 138 degrees. Yet another advantage of fluid coupling 200 is that it is capable of shearing solid particles caught between the spout fluid openings 120' and 138' and connector fluid openings 31' and 62*a'*, as explained with reference to fluid coupling 10.

For detaching the service-line connector 204 from the spout assembly 202, the connector valve member 208 is rotated in a preferably counter-clockwise direction. During this rotation, the force of the connector rim 33' against the spout rim 236 forces the spout valve member 220 to rotate with the connector valve member 208. The connector valve member 208 is rotated counter-clockwise until the fingers 218 abut the rotation-limiting members 216. In this position, the fingers 218 are aligned with their corresponding recesses 228. When this occurs, both valves of the service-line connector 204 and spout assembly 202 are closed, as shown in FIG. 8A. The service-line connector 204 is then removed from the spout assembly 202 such that the fingers 218 slides through and above recesses 228.

Figure 9:
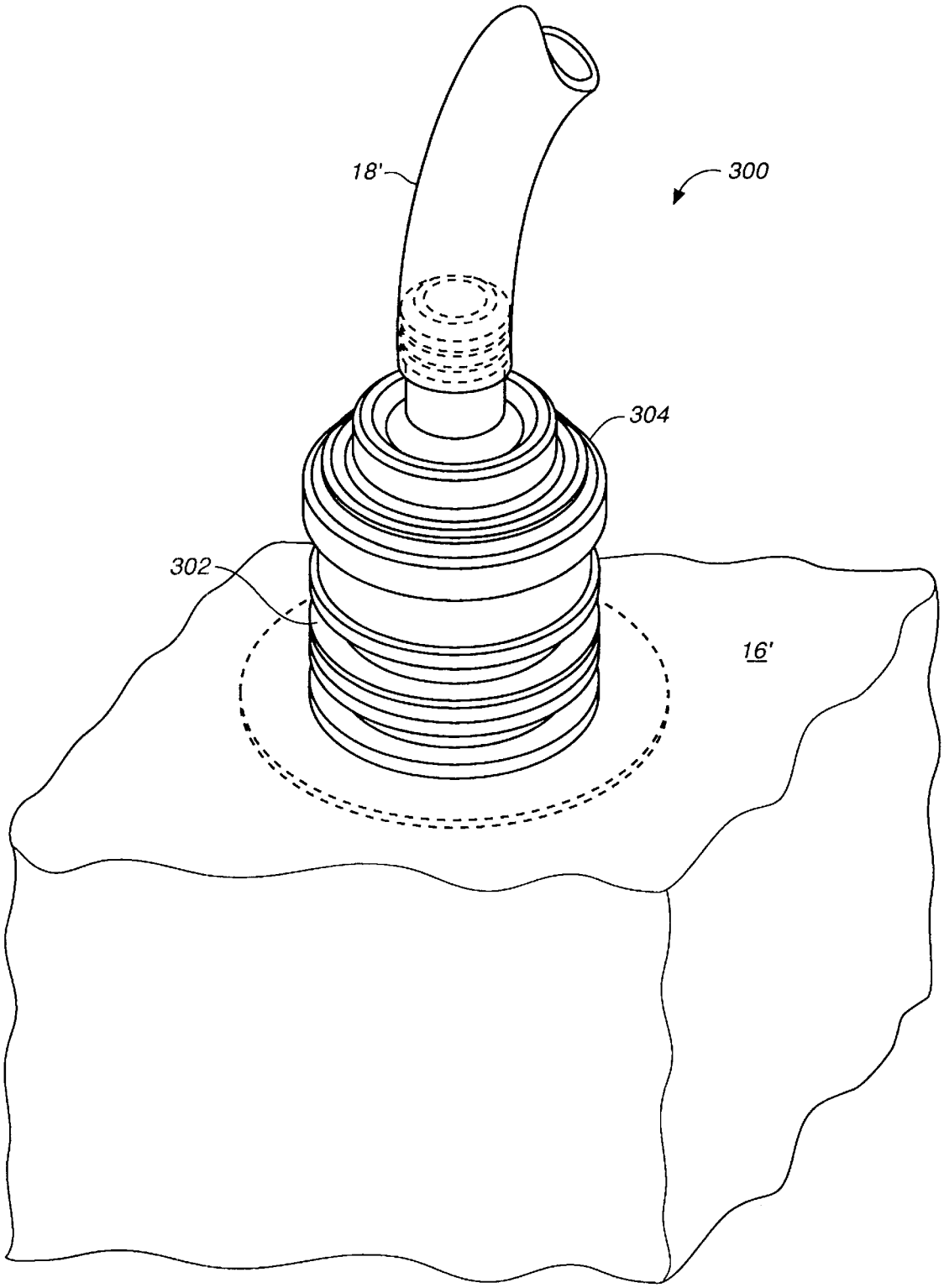
FIG. 9 shows a top perspective view of a quick-disconnect fluid coupling as an example of a third embodiment of the invention.

Referring now to FIG. 9, a top perspective view of yet another quick-disconnect fluid coupling 300 is shown. Although fluid coupling 300 differs in many respects to the fluid couplings of embodiments 10 and 200; however, similar elements in fluid coupling 300 that are in fluid coupling 10 and 200 will have the same reference number, but with the addition of a prime. The detail discussions of such similar elements of fluid coupling 200 will not follow, since these were discussed earlier with respect to fluid couplings 10 and 200.

The quick-disconnect fluid coupling 300 comprises a spout assembly 302 attached to and in fluid communication with a service-line connector 304. The spout assembly 302 is typically attached to a flexible container 16' for serving as the container's spout. The service-line connector is typically attached to a fluid flow line 181 for fluid communicating therethrough with a dispensing apparatus or the like.

Figure 10A:
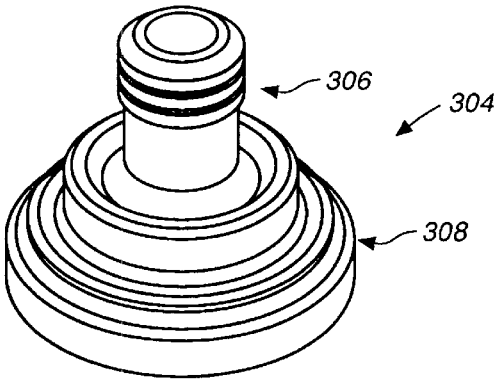
FIGS. 10A–10C show assembled top perspective, disassembled top perspective, and disassembled bottom perspective views, respectively, of a service-line connector as per the third embodiment of the invention.
Figure 10B:
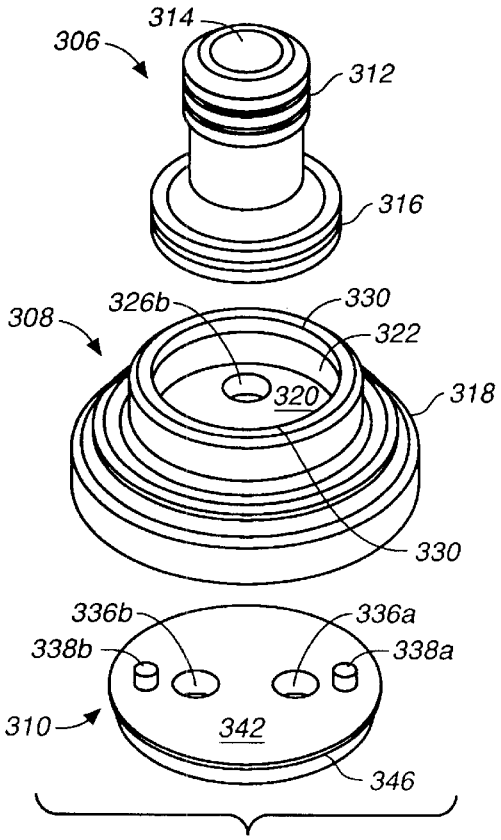
Figure 10C:
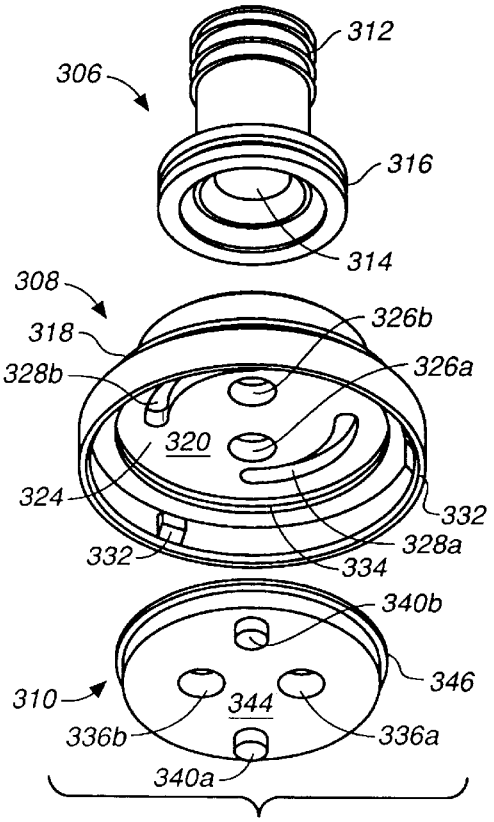

Referring now to FIGS. 10A–10C, assembled top perspective, disassembled top perspective and disassembled bottom perspective views of the service-line connector 304 are shown. The service-line connector 304 comprises a line-fitment member 306, an upper connector valve member 308 and a lower connector valve member 310. The line fitment member 306 includes a first fitting 312 for attaching to fluid flow line 18' and having a fluid opening or passageway therethrough 314 for fluid communicating with the fluid flow line 18'. The line fitment member 312 also includes a base 316 for attachment of the line fitment member 306 to the upper connector valve member 308.

The upper connector valve member 308 comprises a generally cylindrical housing 318 having a wall 320 that separates the interior of the housing into an opened upper and lower chambers 322 and 324. The wall 320 preferably includes therethrough a pair of fluid openings 326*a–b*. The wall 320 further includes therethrough a pair of semi-annular slots 328*a–b*.

The rim at the top of the upper chamber 322 of the upper connector valve member 308 includes an annular lip 330 there around that extends radially inward into the upper chamber. The inside wall of the housing 318 at the lower chamber 324 includes a plurality of tabs 332 that are radially spaced apart from each other. Also included on the housing 318 at its lower chamber 324 is an annular track 334 situated below and adjacent to wall 320. The annular track 334 preferably has a smaller diameter than the inside wall of the housing 318 at the lower chamber 324.

The lower connector valve member 310 is preferably formed into a substantially disk-shaped member having a top face 342 and bottom face 344. The lower connector valve member 310 includes a pair of fluid openings 336*a–b*. The fluid openings 336*a–b* are preferably situated a distance away from the center axis of the disk-like structure, and each symmetrically on opposing sides thereof. Extending upwards from the top face 342 are a pair of posts 338*a–b* that are preferably radially aligned with each corresponding fluid opening, but farther from the center axis of the disk-like structure than the fluid openings are. Extending downward from the lower face 344 of the lower connector valve member 310 are another pair of posts 340*a–b* that are each preferably situated at opposite ends of the disk-like structure at the same distance from the center axis as posts 338*a–b* are situated, but radially oriented at 90 degrees apart therefrom. The lower connector valve member 310 further includes an annular extension 346 of the top face 324.

The assembly of the service-line connector 304 will be explained as follow. The line-fitment member 306 is mechanically coupled to the upper connector valve member 308 by inserting the base 316 of the line-fitment member into the upper chamber 322 in a manner that the base 316 sits coaxially within the upper chamber and is positively seated on wall 320. The base 316 of the line-fitment member 306 is snapped into and retained in the upper chamber 322 by the lip 330 overlying and against the top surface of base 316. The line fitment member 308 is situated within the upper chamber 322 such that the upper connector valve member 308 can rotate about its longitudinal axis with respect to the line fitment member.

Once the line-fitment member 306 is situated properly within the upper chamber 322 of the upper connector valve member 308, the lower connector valve member 310 is then mechanically coupled to the upper connector valve member. This is performed by inserting the lower connector valve member 310 into the lower chamber 324 of the upper connector valve member 308 in a manner that the annular extension 346 is situated within the annular track 334. Also, the lower connector valve member 310 is also situated within the lower chamber 324 of the upper connector valve member 308 in a manner that posts 338*a–b* are situated through annular slots 328*a–b*, respectively.

The lower connector valve member 310 is also situated within the lower chamber of the upper connector valve member 308 such that the latter is capable of rotating about its longitudinal axis with respect to the former. The annular rim extension 346 being situated within annular track 334 guides the rotation of the upper connector valve member 308 with respect to lower connector valve member 310. The annular slots 328*a–b* provides limits to the extent in which the upper connector valve member 308 can be rotated with respect to the lower connector valve member 310. These limits occur when the posts 338*a–b* encounter the ends of annular slots 328*a–b*, respectively.

The service-line connector 304 is preferably initially assembled in its closed valve position, whereat the fluid openings 326*a–b* of the upper connector valve member 308 do not overlap with the fluid openings 336*a–b*; thereby, not forming a connector fluid path therethrough. Preferably, in the closed valve position, the fluid openings 328*a–b* are radially oriented 90 degrees apart from fluid openings 338*a–b*. In this position, the posts 338*a–b* abut the clockwise ends of annular slots 328*a–b*. The top face 324 of the lower connector valve member 310 held against the bottom of wall 320 forms a fluid seal therebetween to prevent fluid from leaking through the fluid openings.

To place the service-line connector 304 in its valve opened position, the upper connector valve member 308 is rotated preferably 90 degrees in the clockwise direction until the posts 338*a–b* abut the counter-clockwise ends of annular slots 328*a–b*, respectively. In this position, the upper connector valve member fluid openings 326*a–b* overlap, and preferably align, with the lower connector valve fluid openings 336*a–b*; thereby, forming a pair of connector fluid paths therethrough.

Figure 11A:
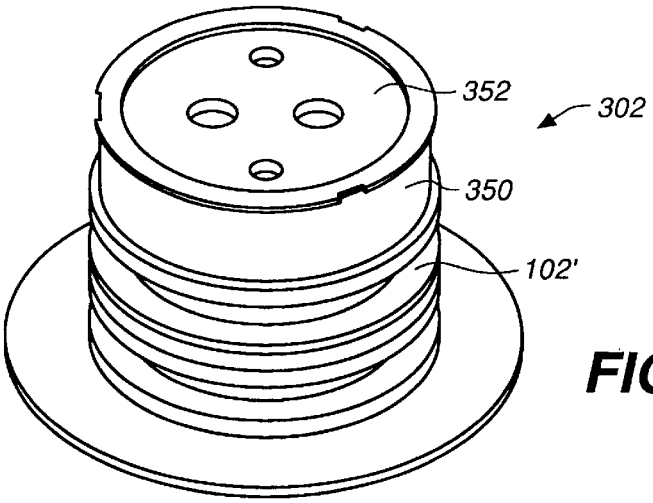
FIGS. 11A–11C show assembled top perspective, disassembled top perspective, and disassembled bottom perspective views, respectively, of a spout assembly as per the third embodiment of the invention.
Figure 11B:
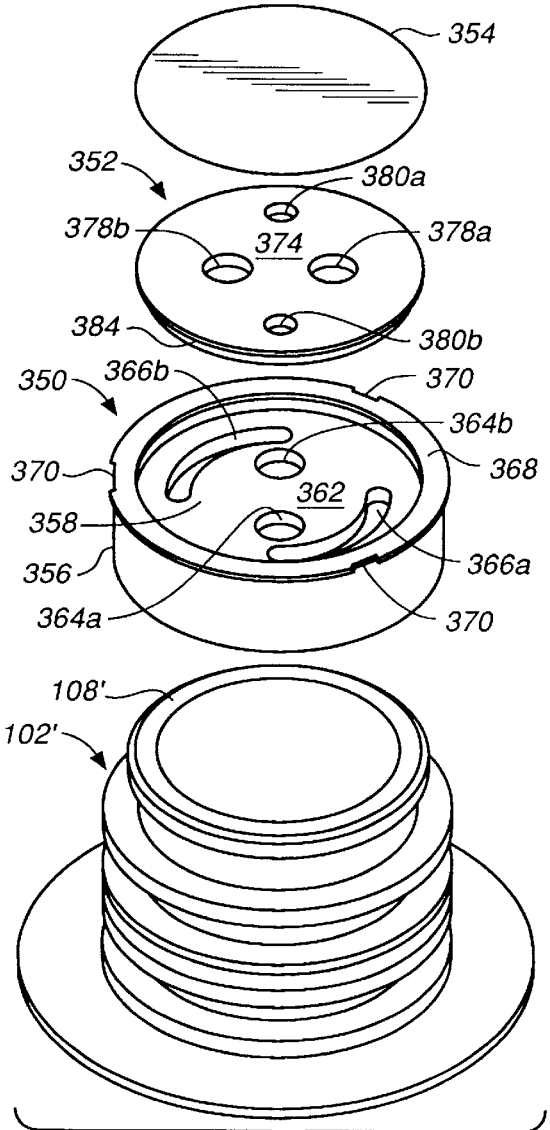
Figure 11C:
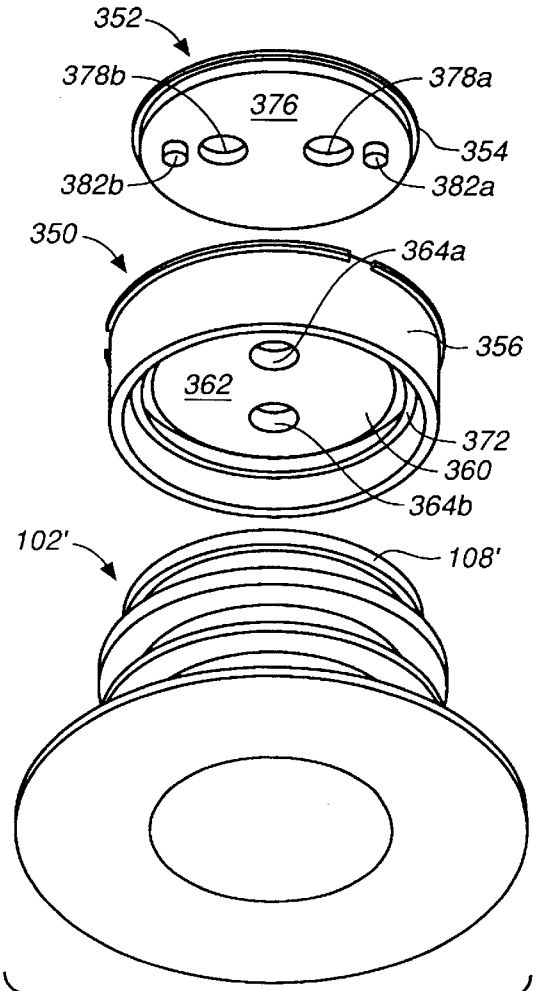

Referring now to FIGS. 11A–11C, assembled top perspective, disassembled top perspective, and disassembled bottom perspective views of the spout assembly 302 as embodied in the invention are shown. The spout assembly 302 comprises a fitting 102', a spout cover 350 and a spout connector valve member 352. The spout assembly 302 may further include, preferably at its initial stage of assembly, a protective sheet 354 which guards against contamination of the spout fluid openings during shipping and handling. The protective sheet 354 is preferably attached to the spout assembly 302 such that it covers fluid openings on the spout valve member 352.

The fitting 102' of the spout assembly 302 is of the same type described with respect to the quick-disconnect fluid couplings 10 and 200. Therefore, the detail discussion of the fitting 102' will not follow.

The spout cover 350 comprises a generally cylindrical housing 356 having an opened upper chamber 358 and an opened lower chamber 360 being separated from each other by traversing wall 362. The wall 362 includes a pair of fluid openings 364*a–b* that extends through the wall from the upper chamber 358 to the lower chamber 360. The traversing wall 362 further includes a pair of semi-annular slots 366*a–b* extending from the top surface of the wall 362 into the wall, but preferably not all the way through the wall.

The spout cover housing 356 further includes at a rim 368 that extends radially inward over the upper chamber 358 and radially outward. The rim 368 includes a plurality of recesses 370 at its outer diameter. The spout cover 350 further includes at its lower chamber 360 an annular groove 372 that is positioned and dimensioned to receive in a tight fit the upper rim 108' of the fitting 102'.

The spout valve member 352 is preferably formed into a substantially disk-like structure that includes a top face 374 and a bottom face 376. The spoilt valve member 352 includes a pair of fluid openings 378*a–b* extending therethrough from the top face 374 down to the bottom face 376. The spout valve member 352 also includes a pair of holes 380*a–b* that extends from the top face 374 toward the bottom face 376, but preferably not therethrough. The spout valve member 352 further includes a pair of posts 382*a–b* that extends downward from the bottom face 376. In addition, the spout valve member includes an annular rim extension 384 that extends radially outward from the top face 374.

The assembly of the spout valve member 302 is explained as follows. The spout cover 350 is secured to the fitting 102' by pressing the spout cover over the fitting such that the top rim 118' of the fitting is inserted into the annular groove 372 at the lower chamber 360. Then the spout valve member 352 is inserted into the upper chamber 358 of the spout cover such that the annular extension 384 lies under and against the underside of top rim 368 of the spout cover. Also, the spout valve member 352 is inserted into the upper chamber 358 in a manner that the posts 382*a–b* of the spout valve member lie within the semi-annular slots 366*a–b*.

Preferably, the spout assembly 302 is assembled initially in its closed valve position. This position lies where the posts 382*a–b* abut the counter-clockwise ends of semi-annular slots 366*a–b*, respectively. In this position, the fluid openings 378*a–b* of the spout valve member 352 are radially situated at 90 degrees apart from fluid openings 364*a–b* of the spout cover member 350 with respect to the service-line connector's central axis. Therefore, the fluid openings 378*a–b* of the spout valve member 352 do not overlap with the fluid openings 364*a–b* of the spout cover 350; thereby not forming a pair of spout fluid paths therethrough.

In order to open the valve of the spout assembly 302, the spout valve member 352 is rotated 90 degrees preferably in the clockwise direction until the posts 382*a–b* abut the clockwise ends of the semi-annular slots 366*a–b*, respectively. In this position, the fluid openings 378*a–b* of the spout valve member 352 overlap, and preferably align, with the fluid openings 364*a–b* of the spout cover 350; thereby forming a spout fluid path therethrough.

Figure 12A:
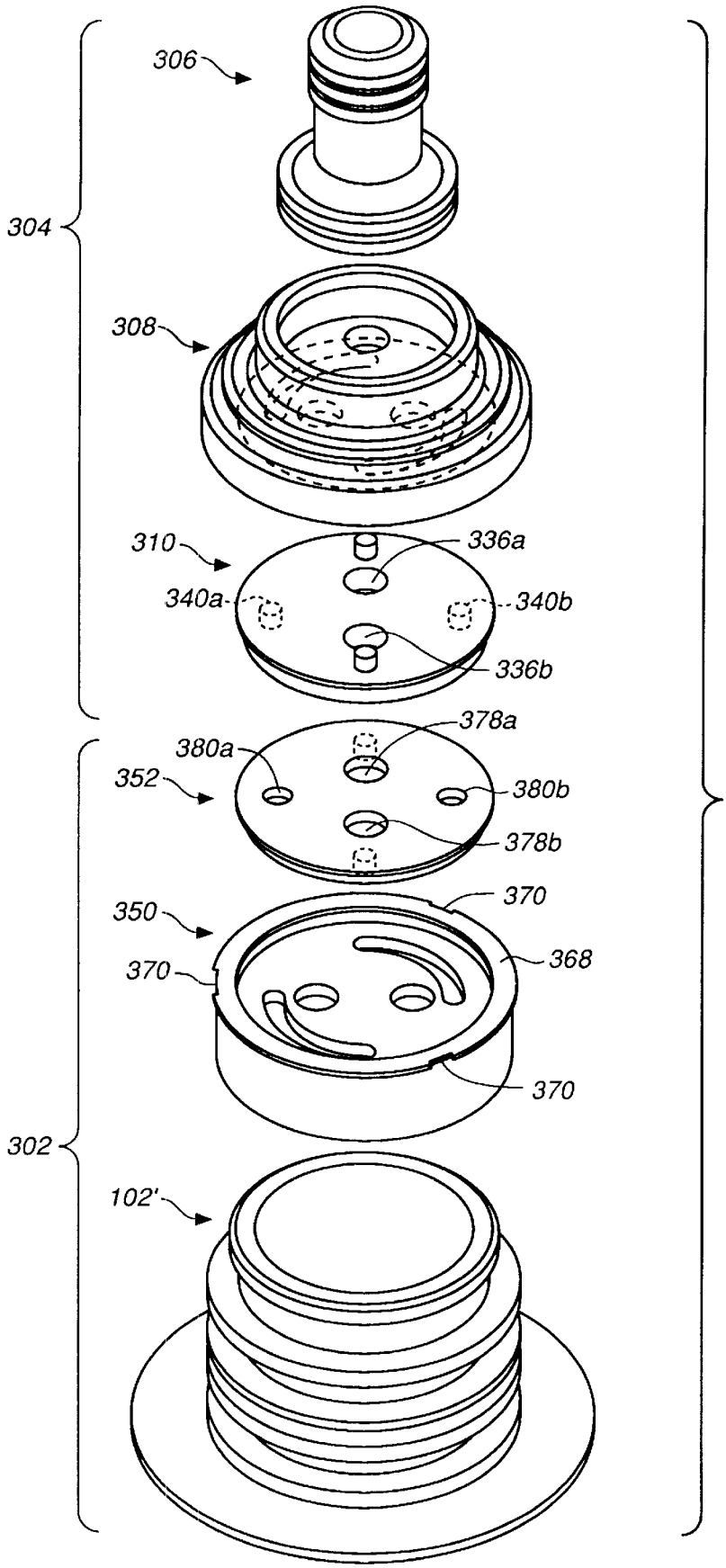
FIGS. 12A–12C show disassembled top perspective views of the quick-disconnect fluid coupling of the third embodiment of the invention in connector and spout closed valve position, connector opened valve and spout closed valve position, and both connector and spout opened valve position, respectively.
Figure 12B:
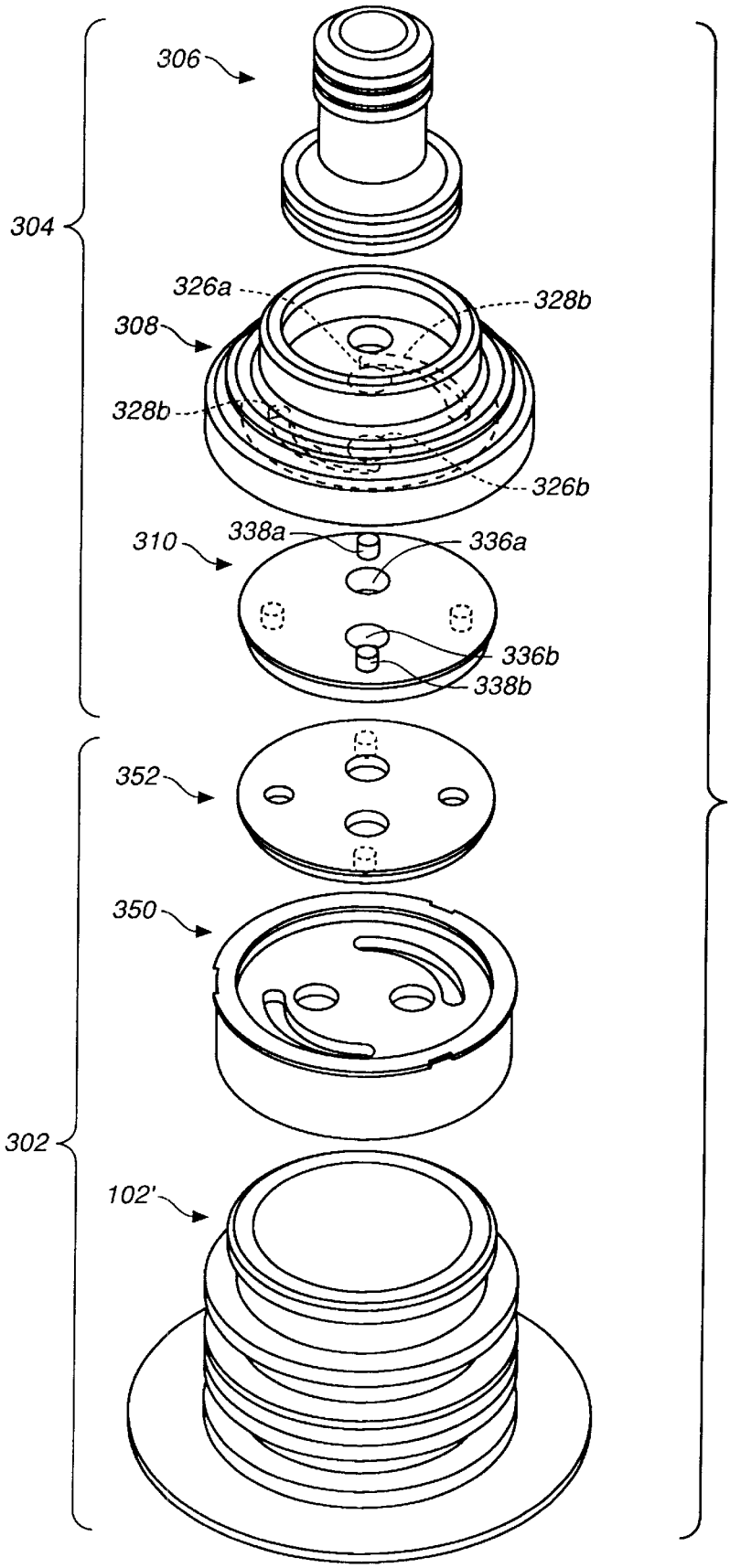
Figure 12C:
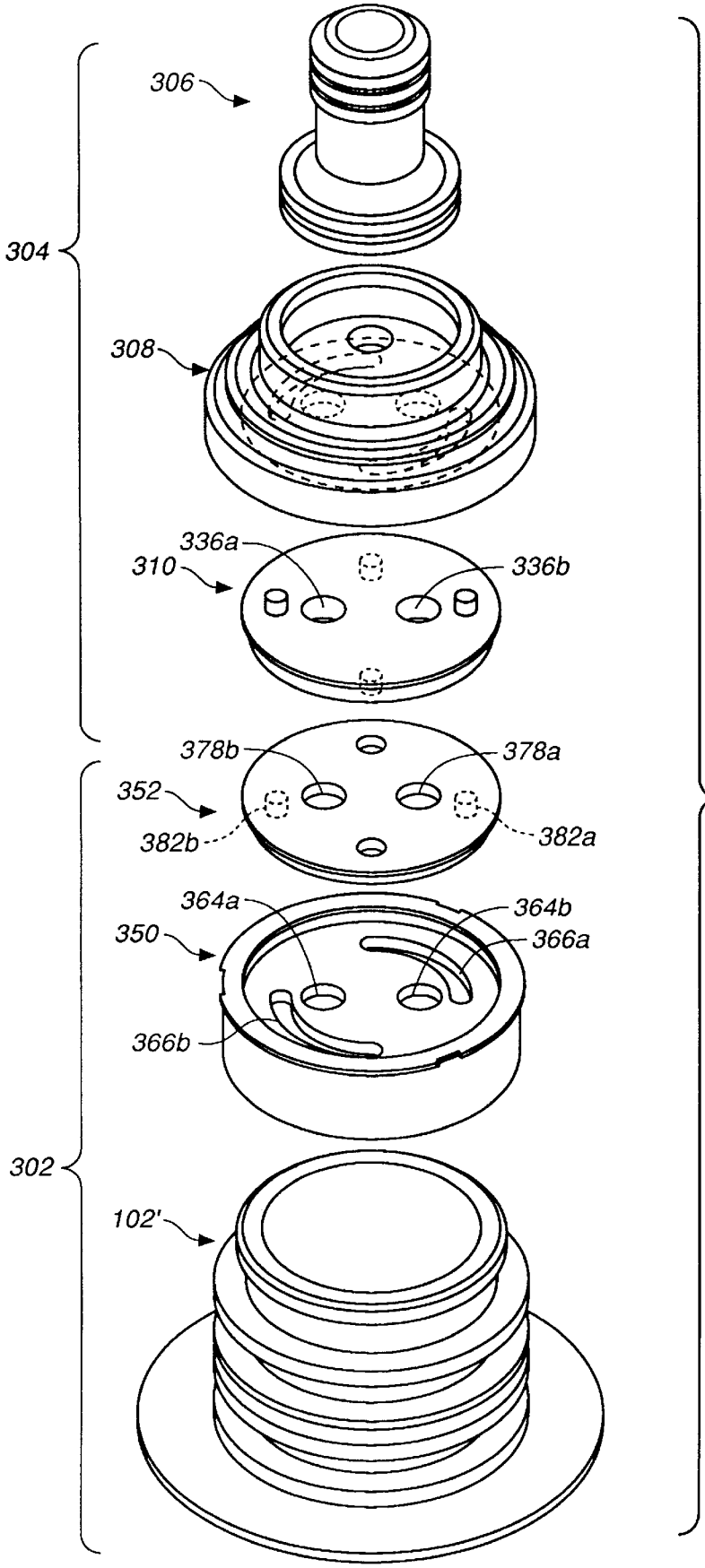

Referring now to FIGS. 12A–12C, top perspective views of the quick-disconnect fluid coupling 300 in a closed valve position, a service-line valve open/spout assembly closed valve position, and a both service-line connector and spout assembly opened valve position, respectively, are shown. The attachment and operation of the valves of fluid coupling 10 will now follow.

As shown in FIG. 12A, when the service-line connector 304 is initially attached to the spout assembly 302, both the service-line connector and the spout assembly have their respective valves in the closed position as described above. The attachment process of the fluid coupling 300 begins by placing the service-line connector 304 on the spout assembly 302 such that the posts 340*a–b* of the lower connector valve member 310 is inserted into holes 380*a–b*, respectively. In this position, the fluid openings 336*a–b* of the lower connector valve member 310 overlap, and preferably aligned, with the fluid openings 378*a–b* of the spout valve member 352, respectively. Also in this position, the three tabs 332 on the inside wall of the upper connector valve member 302 (not shown in FIG. 12A) have slid through the corresponding recesses 370.

Then as shown in FIG. 12B, the upper connector valve 308 is rotated 90 degrees clockwise until the posts 338*a–b* abut the counter-clockwise ends of the semi-annular slots 328*a–b*, respectively. In this position, the fluid openings 326*a–b* of the upper connector valve member 308 overlap, and preferably align, with the fluid openings 336*a–b* of the lower connector valve member 310; thereby forming the pair of connector fluid paths through such fluid openings.

Then as shown in FIG. 12C, the upper connector valve member 308 is rotated another 90 degrees in the clockwise direction until the posts 382*a–b* abut the clockwise ends of semi-annular slots 366*a–b*, respectively. In this position, the fluid openings 378*a–b* of the spout valve member 352 overlap, and preferably align, with the fluid openings 364*a–b* of the spout cover 350; thereby forming the pair of spout fluid paths therethrough. Since the pair of spout-connector fluid paths between the service-line connector 304 and the spout assembly 302 exists through fluid openings 336*a–b* and 378*a–b* upon the service-line connector being attached to the spout assembly, the connector and spout fluid paths are coupled in series by way of the spout-connector fluid path to form a pair of substantially straight fluid paths within the fluid coupling 300. Also in this position, the three tabs 332 of the upper connector valve member 308 (not shown in FIG. 12B) are held against the underside of the spout cover rim 368; thereby securely attaching the service-line connector 304 to the spout assembly 302.

The service-line connector 304 is detached from the spout assembly 302 by an opposite rotation of the upper connector valve member 308, preferably in the counter-clockwise direction. An initial 90 degree counter-clockwise rotation of the upper connector valve member 308 places the fluid coupling 300 in the orientation shown in FIG. 12B where the spout valve is closed and the connector valve is opened. Then a subsequent 90 degree counter-clockwise rotation of the upper connector valve member 308 places the fluid coupling in the orientation shown in FIG. 12A, where both the connector and spout valve are in their closed position. Then the service-line connector is pulled off the spout assembly 302, whereby the tabs 332 of the upper connector valve member 308 slides upwards through the recesses 370 of the spout cover 352.

An advantage of the quick-disconnect fluid coupling 300 of the invention is that it provides a pair of substantially straight fluid paths within the coupling. This allows for increased fluid flow through the coupling, which is particularly useful for dispensing viscous fluid products, such as condiments. Another advantage of the fluid coupling 300 the edges of the spout fluid openings and the connector fluid openings are capable of shearing solid particles caught between those openings, as described per fluid couplings 10 and 200. This provides the advantage of the coupling to recover from solid particle obstruction.

It is to be understood that while the invention has been described above in conjunction with preferred specific embodiments, the description and examples are intended to illustrate and not limit the scope of the invention, which is defined by the scope of the appended claims.

It is claimed:

1. A quick-disconnect fluid coupling for selectively providing a substantially straight fluid path through said coupling, comprising:

a spout assembly for attachment to and fluid communication with a container comprising:

a spout fitment including a cover having a first fluid opening for fluid communicating therethrough with the interior of the container, and a spout valve member having a second fluid opening and capable of rotating from a first position whereat there is an absence of a spout fluid path coupling said first and second fluid openings, to a second position whereat there is a presence of said spout fluid path coupling said first and second fluid openings; and a service-line connector comprising:

a line fitment member including a line fitting for attachment to and fluid communication with a fluid flow line, said fitting including a third fluid opening, and a connector valve member having a fourth fluid opening and capable of rotating from a third position whereat there is an absence of a connector fluid path coupling said third and fourth fluid openings, to a fourth position whereat there is a presence of said connector fluid path coupling said third and fourth fluid openings, said fourth fluid opening being situated with respect to said second fluid opening of said spout valve member that upon attachment of the service-line connector to the spout assembly, a spout-connector fluid path is formed coupling said second and fourth fluid openings, said connector valve member further including an engagement mechanism for engaging with said spout valve member in a manner that rotation of said connector valve member from said third position to said fourth position causes said spout valve member to rotate from said first position to said second position, whereat said spout fluid path, said spout-connector fluid path and said connector fluid path are coupled in series, thereby forming said substantially straight fluid path.

2. The quick-disconnect fluid coupling of claim 1, further including a sealing member retained in a holding plate that are both interposed between said line-fitment member and said connector valve member in a manner that both said sealing member and holding plate include at least a portion thereof that surround said third fluid opening of said line-fitment such that when said connector valve member is in said third position, a fluid seal is formed between said connector valve member and line-fitment member.

3. The quick-disconnect fluid coupling of claim 1, wherein said engagement mechanism includes a first rim extension extending from the periphery of said fourth fluid opening of said connector valve member that is held against a second rim extension extending from the periphery of said second fluid opening of said spout valve member in a manner that rotation of the connector valve member from said third position to said fourth position causes said first rim extension to urge said second rim extension in the direction of rotation so that the spout valve member rotates with said connector valve member.

4. The quick-disconnect fluid opening of claim 1, wherein the connector valve member includes an attachment mechanism that provides a secured attachment of the service-line connector to the spout assembly when said connector valve member is rotated from said third position to said fourth position.

5. The quick-disconnect fluid coupling of claim 1, wherein the spout valve member includes a wall having said second fluid opening therethrough that is concaved in shape.

6. The quick disconnect fluid coupling of said claim 1, wherein the edges of said fourth fluid opening and said portion of said holding plate that surrounds said third fluid opening of the line-fitment member are oriented with respect to each other that the edges are capable of shearing a first solid particle caught in between said fluid opening and said holding plate portion when the connector valve member is rotated from said fourth position towards said third position, and further wherein the edges of said first and second fluid openings are oriented with respect to each other that said edges are capable of shearing a second solid particle caught in between said fluid openings when the spout valve member is rotated from said second position towards said first position.

7. A spout assembly for attachment to and fluid communication with a service-line connector comprising:

a spout fitment including a cover having a first fluid opening therethrough; and a spout valve member having a second fluid opening therethrough and capable of rotating from a first position whereat there is an absence of a spout fluid path coupling said first and second fluid openings, to a second position whereat there is a presence of said spout fluid path coupling said first and second fluid openings the spout valve member further having an engagement mechanism capable of engaging with a rotating member of said service-line connector in a manner that rotation of said rotating member causes said spout valve member to rotate from said first position to said second position, wherein said engagement mechanism includes a first rim extension extending from the periphery of said second fluid opening that is capable of engaging with at least a portion of said rotating member of said service-line connector.

8. A spout assembly for attachment to and fluid communication with a service-line connector comprising:

a spout fitment including a cover having a first fluid opening therethrough; and a spout valve member having a second fluid opening therethrough and capable of rotating from a first position whereat there is an absence of a spout fluid path coupling said first and second fluid openings, to a second position whereat there is a presence of said spout fluid path coupling said first and second fluid openings, the spout valve member further having an engagement mechanism capable of engaging with a rotating member of said service-line connector in a manner that rotation of said rotating member causes said spout valve member to rotate from said first position to said second position, wherein the spout valve member includes a first concave wall having said second fluid opening therethrough and said cover includes a second concave wall having said first fluid opening, wherein said first concave wall is situated tangentially against said second concave wall.

9. The spout assembly of claim 8, wherein the edges of said first and second fluid openings are oriented with respect to each other that said edges are capable of shearing a solid particle caught in between said openings when the spout valve member is rotated from said second position towards said first position.

10. A service-line connector for attachment to and fluid communication with a spout assembly and a fluid flow line, comprising:

a line fitment member including a line fitting for attachment to and fluid communication with said fluid flow line, said fitting including a first fluid opening; and a connector valve member having a second fluid opening and capable of rotating from a first position whereat there is an absence of a connector fluid path coupling said first and second fluid openings, to a second position whereat there is a presence of said connector fluid path coupling said first and second fluid openings, said connector valve member further including an engagement mechanism for engaging with a rotating valve member of said spout assembly in a manner that upon rotation of said connector valve member from said first position to said second position causes said spout rotating valve member to rotate to an opened valve position for establishing a fluid connection between said spout assembly and said service line-connector through said second fluid opening.

11. The service line-connector of claim 10, further including a sealing member retained in a holding plate that are both sandwiched between said line-fitment member and said connector valve member in a manner that both said sealing member and holding plate include at least a portion thereof that surround said third fluid opening of said line-fitment such that when said connector valve member is in said third position, a fluid seal is formed between said connector valve member and line-fitment member when said connector valve member is in said third position.

12. The service line-connector of claim 10, wherein said engagement mechanism includes a first rim extension extending from the periphery of said second fluid opening that is capable of engaging with said rotating member of said spout assembly.

13. The service-line connector of claim 10, wherein the connector valve member includes an attachment mechanism for providing a secured attachment of the line-connector to the spout assembly as the connector valve member is rotated from said first position to said second position.

14. The service-line connector of said claim 10, wherein the edges of said second fluid opening and edges of said portion of said holding plate that surrounds said third fluid opening are oriented with respect to each other that said edges are capable of shearing a solid particle caught in between said fluid opening and said holding plate hole when the connector valve member is rotated from said second position towards said first position.

15. A valve structure for selectively establishing a substantially straight fluid path from a proximal end to a distal end of said valve structure, comprising:

a first stationary member situated at said proximal end of said valve structure and having a first fluid opening therethrough;

a first valve member situated closer to said distal end than said first stationary valve member, said first valve member having a second fluid opening therethrough and capable of movement with respect to said first stationary valve member from a first position whereat there is an absence of a first fluid path coupling said first and second fluid openings, to a second position whereat there is a presence of said first fluid path coupling said first and second fluid openings, a second stationary valve member situated at said distal end and having a third fluid opening therethrough; and a second valve member situated closer to said distal end than said first valve member, but farther from said distal end than said second stationary valve member, said second valve member having a fourth fluid opening therethrough and capable of movement from a third position whereat there is an absence of a second fluid path coupling said third and fourth fluid openings, to a fourth position whereat there is a presence of said second fluid path coupling said third and fourth fluid openings, said second valve member further including an engagement mechanism for engaging with said first valve member in a manner that movement of said second valve member from said third position to said fourth position causes said first valve member to move from said first position to said second position, whereat said first and second fluid paths are coupled to form said substantially straight fluid path.

16. The valve structure of claim 15, wherein the movement of said first valve member from said first position to said second position involves a rotation of less than 180-degree angle about a fixed rotational axis of said first valve member.

17. The valve structure of claim 16, wherein the movement of said second valve member from said third position to said fourth position involves a rotation of less than 180-degree angle about a fixed rotational axis of said first valve member.

18. A quick-disconnect fluid coupling for selectively providing a substantially straight fluid path within said coupling, comprising:

a spout assembly for attachment to and fluid communication with a container comprising:

a spout fitment including a cover having a first fluid opening for fluid communicating therethrough with the interior of said container, and a spout valve member having a second fluid opening and capable of rotating from a first position whereat there is an absence of a spout fluid path coupling said first and second fluid openings, to a second position whereat there is a presence of said spout fluid path coupling said first and second fluid openings; and a service-line connector comprising:

a line fitting having a fitting fluid path therein, for attachment to and fluid communication with said fluid flow line, a first connector valve member having a third fluid opening and being capable of rotating from a third position to a fourth position, and further having a first engagement mechanism for engaging with said spout valve member in a manner that upon attachment of said service-line connector to said spout assembly, a spout-connector fluid path is formed between said second and third fluid openings, and in a further manner that rotation of said first connector valve member from said third position to said fourth position causes said spout valve member to rotate from said first position to said second position, and a second connector valve member having a fourth fluid opening for fluid communicating therethrough with said fitting fluid path, said second connector valve member being capable of rotating from a fifth position whereat there is an absence of a connector fluid path coupling said third and fourth fluid openings, to a sixth position whereat there is a presence of a connector fluid path coupling said third and fourth fluid openings, said second connector valve member further capable of rotating to a seventh position and including a second engagement mechanism for engagement with said first connector valve member in a manner that rotation of said second connector valve member from said sixth position to said seventh position, causes said first connector valve member to rotate from said third position to said fourth position, whereat said spout fluid path, spout-connector fluid path and connector fluid path are coupled in series to form said substantially straight fluid path.

19. The quick-disconnect fluid coupling of claim 18, wherein the first engagement means of the first connector valve member includes a post that engages with a hole on said spout valve member.

20. The quick-disconnect fluid coupling of claim 18, wherein the second engagement mechanism of said second connector valve member includes an semi-annular slot dimensioned and positioned to receive a post from said first connector valve member.

21. A service-line connector for attachment to and fluid communication with a spout assembly and a fluid flow line, comprising:

a line fitting having a fitting fluid path therein, for attachment to and fluid communication with said fluid flow line, a first connector valve member having a first fluid opening and being capable of rotating from a first position to a second position, and further having a first engagement mechanism for engaging with a rotating valve member of said spout assembly in a manner that upon rotation of said first connector valve member from said first position to said second position causes said spout rotating valve member to rotate to an opened valve position for establishing a fluid connection between said spout assembly and said service line-connector through said first fluid opening; and a second connector valve member having a second fluid opening for fluid communicating therethrough with said fitting fluid path, said second connector valve member being capable of rotating from a third position whereat there is an absence of a connector fluid path coupling said first and second fluid openings, to a fourth position whereat there is a presence of said connector fluid path coupling said first and second fluid openings, said second connector valve member further capable of rotating to a fifth position and including a second engagement mechanism for engaging with said first connector valve member in a manner that rotation of said second connector valve member from said fourth position to said fifth position, causes said first connector valve member to rotate from said first position to said second position.

22. The service line-connector of claim 21, wherein the first engagement means of the first connector valve member includes a post capable of engagement with a hole of said rotating spout valve member.

23. The service line-connector of claim 21, wherein the second engagement mechanism of said second connector valve member includes an annular slot dimensioned and positioned to receive therein a post extending from said first connector valve member.

24. A valve structure for selectively establishing a substantially straight fluid path from a proximal end to a distal end of said valve structure, comprising:

a first stationary member situated at said proximal end of said valve structure and having a first fluid opening therethrough;

a first valve member situated closer to said distal end than said first stationary valve member, said first valve member having a second fluid opening therethrough and capable of movement with respect to said first stationary valve member from a first position whereat there is an absence of a first fluid path coupling said first and second fluid openings, to a second position whereat there is a presence of said first fluid path coupling said first and second fluid openings;

a second valve member situated closer to said distal end than said first valve member distal end, said second valve member having a third fluid opening and capable of movement from a third position to a fourth position, said second valve member having a first engagement mechanism for engaging with said first valve member in a manner that a second fluid path couples said second and third fluid openings, and in a further manner that movement of said second valve member from said third position to fourth position causes said first valve member to move from said first position to said second position, thereby coupling said first and second fluid paths; and a third valve member situated at said distal end, said third valve member having a fourth fluid opening and capable of movement from a fifth position whereat there is an absence of a third fluid path coupling said third and fourth openings, to a sixth position whereat there is an presence of said third fluid path coupling said third and fourth openings, said third valve member further including a second engagement mechanism for engaging with said second valve member in a manner that movement of said third valve member from said sixth position to a seventh position causes said second valve member to move from said third position to said fourth position, whereat said first, second and third fluid paths are coupled in series to form said substantially straight fluid path.

25. The valve structure of claim 24, wherein the first engagement means of the second valve member includes a post extending through an semi-annular slot on said first valve member.

26. The valve structure of claim 24, wherein the second engagement mechanism of said third valve member includes a semi-annular slot dimensioned and positioned to receive therein a post extending from said first valve member.

* * * * *